US009633614B2

(12) United States Patent
Kabe et al.

(10) Patent No.: US 9,633,614 B2
(45) Date of Patent: Apr. 25, 2017

(54) DISPLAY DEVICE AND A METHOD FOR DRIVING A DISPLAY DEVICE INCLUDING FOUR SUB-PIXELS

(71) Applicant: Japan Display Inc., Tokyo (JP)

(72) Inventors: Masaaki Kabe, Tokyo (JP); Fumitaka Gotoh, Tokyo (JP); Kazuhiko Sako, Tokyo (JP); Toshiyuki Nagatsuma, Tokyo (JP); Kojiro Ikeda, Tokyo (JP); Tsutomu Harada, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 14/972,250

(22) Filed: Dec. 17, 2015

(65) Prior Publication Data

US 2016/0196787 A1 Jul. 7, 2016

(30) Foreign Application Priority Data

Jan. 6, 2015 (JP) ..... 2015-001092

(51) Int. Cl.
*G09G 3/36* (2006.01)
*G09G 3/20* (2006.01)

(52) U.S. Cl.
CPC ..... *G09G 3/3607* (2013.01); *G09G 3/2092* (2013.01); *G09G 2300/0452* (2013.01); *G09G 2340/00* (2013.01); *G09G 2340/06* (2013.01)

(58) Field of Classification Search
CPC ..... G09G 2300/0452; G09G 2340/00; G09G 2340/06; G09G 3/2092
See application file for complete search history.

(56) References Cited

U.S. PATENT DOCUMENTS 8,693,776 B2 * 4/2014 Intwala ..... G06T 5/20 382/164
2009/0046307 A1 * 2/2009 Kwak ..... G09G 5/02 358/1.9
2009/0315921 A1 * 12/2009 Sakaigawa ..... G09G 3/2003 345/694
2009/0322802 A1 * 12/2009 Noguchi ..... G09G 3/2003 345/694

(Continued)

FOREIGN PATENT DOCUMENTS

JP 2010-033009 2/2010
JP 2012-022217 2/2012

(Continued)

*Primary Examiner* — Andrew Sasinowski
*Assistant Examiner* — Chun-Nan Lin
(74) *Attorney, Agent, or Firm* — K&L Gates LLP

(57) ABSTRACT

According to an aspect, a display device includes an image display panel and a signal processing unit. The signal processing unit derives a generation signal for a fourth sub-pixel in each of pixels based on an input signal for a first sub-pixel, an input signal for a second sub-pixel, an input signal for a third sub-pixel, and an extension coefficient. The signal processing unit derives a correction value based on a hue of an input color corresponding to a color to be displayed based on the input signal for the first sub-pixel, the input signal for the second sub-pixel, and the input signal for the third sub-pixel. The signal processing unit derives the output signal for the fourth sub-pixel in each of the pixels based on the generation signal for the fourth sub-pixel and the correction value and outputs the output signal to the fourth sub-pixel.

13 Claims, 11 Drawing Sheets

(56) References Cited

U.S. PATENT DOCUMENTS

| | | | | |
|---|---|---|---|---|
| 2010/0007679 | A1* | 1/2010 | Sakaigawa | G09G 3/3406 345/690 |
| 2012/0013649 | A1* | 1/2012 | Higashi | G09G 3/3426 345/690 |
| 2013/0063474 | A1* | 3/2013 | Chen | G09G 3/3611 345/604 |
| 2013/0241810 | A1* | 9/2013 | Higashi | G09G 3/3406 345/77 |
| 2014/0125689 | A1 | 5/2014 | Ikeda et al. | |
| 2015/0109320 | A1* | 4/2015 | Yata | G09G 3/2003 345/590 |
| 2015/0109350 | A1 | 4/2015 | Gotoh et al. | |

FOREIGN PATENT DOCUMENTS

| | | |
|---|---|---|
| JP | 2012-108518 | 6/2012 |
| JP | 2014-112180 | 6/2014 |
| JP | 2015-082024 | 4/2015 |

* cited by examiner

DISPLAY DEVICE AND A METHOD FOR DRIVING A DISPLAY DEVICE INCLUDING FOUR SUB-PIXELS

CROSS-REFERENCE TO RELATED APPLICATIONS

This application claims priority from Japanese Application No. 2015-001092, filed on Jan. 6, 2015, the contents of which are incorporated by reference herein in its entirety.

BACKGROUND

1. Technical Field

The present disclosure relates to a display device and a method for driving the display device.

2. Description of the Related Art

There has recently been an increasing demand for display devices designed for mobile apparatuses and the like, such as mobile phones and electronic paper. Such display devices include pixels each having a plurality of sub-pixels that output light of respective colors. The display devices switch on and off display on the sub-pixels, thereby causing one pixel to display various colors. Display characteristics, such as resolution and luminance, of the display devices are being improved year by year. An increase in the resolution, however, may possibly reduce an aperture ratio. Accordingly, to achieve higher luminance, it is necessary to increase the luminance of a backlight, resulting in increased power consumption in the backlight. To address this, there has been developed a technology for adding a white pixel serving as a fourth sub-pixel to conventional red, green, and blue sub-pixels (e.g., Japanese Patent Application Laid-open Publication No. 2012-108518 (JP-A-2012-108518)). With this technology, the white pixel increases the luminance, thereby reducing a current value in the backlight and the power consumption. There has also been developed a technology for improving the visibility under external light outdoors with the luminance increased by the white pixel when the current value in the backlight need not be reduced (e.g., Japanese Patent Application Laid-open Publication No. 2012-22217 (JP-A-2012-22217)).

When an image is displayed, a phenomenon called simultaneous contrast may possibly occur. The simultaneous contrast is the following phenomenon: when two colors are displayed side by side in one image, the two colors mutually affect to look contrasted with each other. Let us assume a case where two colors with different hues are displayed in one image, for example. In this case, the hues are recognized in a deviated manner by an observer, whereby one of the colors with a hue having lower luminance may possibly look darker, for example. The technology described in JP-A-2012-22217 derives an extension coefficient (expansion coefficient) for extending (expanding) an input signal based on a gradation value of the input signal. With this technology, the extension coefficient may possibly be fixed in a case where colors have different hues. As a result, the technology described in JP-A-2012-22217, for example, may possibly make the color with a hue having lower luminance look darker because of the simultaneous contrast, thereby deteriorating the image.

For the foregoing reasons, there is a need for a display device that suppresses deterioration in an image and a method for driving the display device.

SUMMARY

According to an aspect, a display device includes: an image display panel including a plurality of pixels each having a first sub-pixel that displays a first color, a second sub-pixel that displays a second color, a third sub-pixel that displays a third color, and a fourth sub-pixel that displays a fourth color; and a signal processing unit that converts an input value of an input signal into an extended value in a color space extended by the first color, the second color, the third color, and the fourth color to generate an output signal and outputs the generated output signal to the image display panel. The signal processing unit determines an extension coefficient for the image display panel. The signal processing unit derives a generation signal for the fourth sub-pixel in each of the pixels based on an input signal for the first sub-pixel, an input signal for the second sub-pixel, an input signal for the third sub-pixel, and the extension coefficient. The signal processing unit derives an output signal for the first sub-pixel in each of the pixels based on at least the input signal for the first sub-pixel, the extension coefficient, and the generation signal for the fourth sub-pixel and outputs the output signal to the first sub-pixel. The signal processing unit derives an output signal for the second sub-pixel in each of the pixels based on at least the input signal for the second sub-pixel, the extension coefficient, and the generation signal for the fourth sub-pixel and outputs the output signal to the second sub-pixel. The signal processing unit derives an output signal for the third sub-pixel in each of the pixels based on at least the input signal for the third sub-pixel, the extension coefficient, and the generation signal for the fourth sub-pixel and outputs the output signal to the third sub-pixel. The signal processing unit derives a correction value for deriving an output signal for the fourth sub-pixel based on a hue of an input color corresponding to a color to be displayed based on the input signal for the first sub-pixel, the input signal for the second sub-pixel, and the input signal for the third sub-pixel. The signal processing unit derives the output signal for the fourth sub-pixel in each of the pixels based on the generation signal for the fourth sub-pixel and the correction value and outputs the output signal to the fourth sub-pixel.

DETAILED DESCRIPTION

Figure 1:
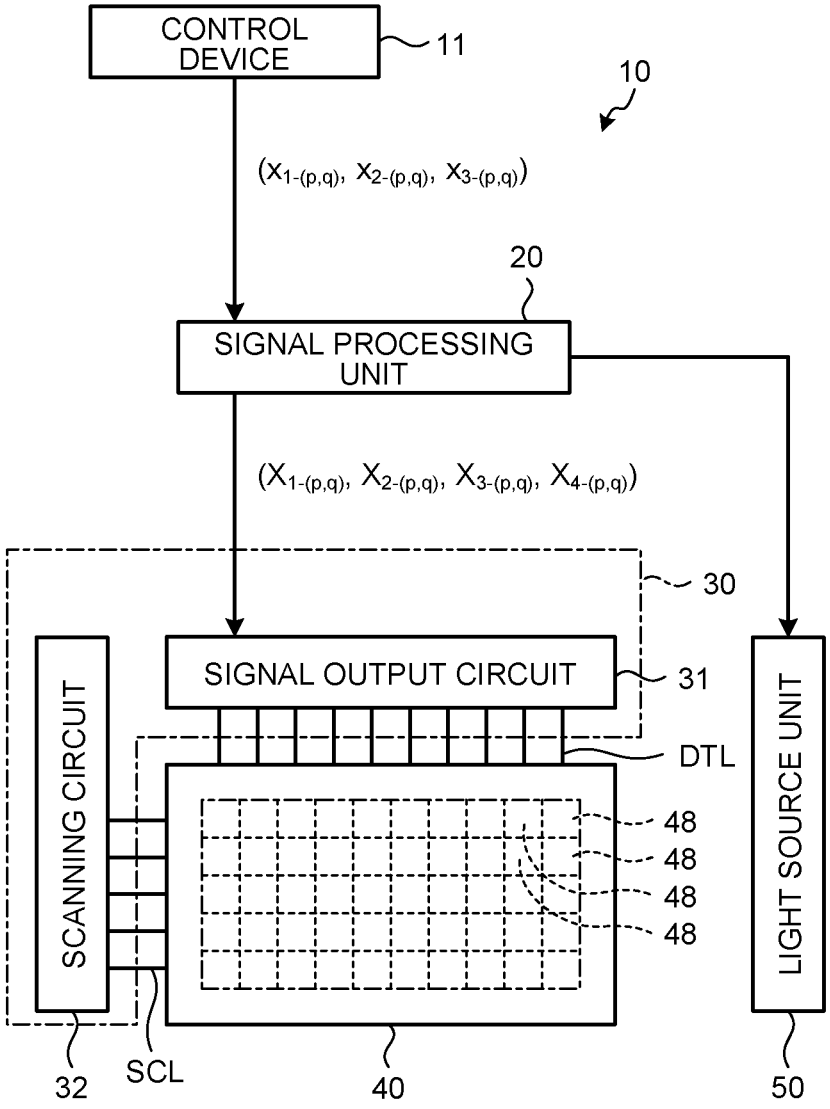
FIG. 1 is a block diagram of an exemplary configuration of a display device according to a first embodiment.

The following describes the embodiments of the present invention with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will be omitted as appropriate in some cases.

1. First Embodiment

Entire Configuration of the Display Device

Figure 2:
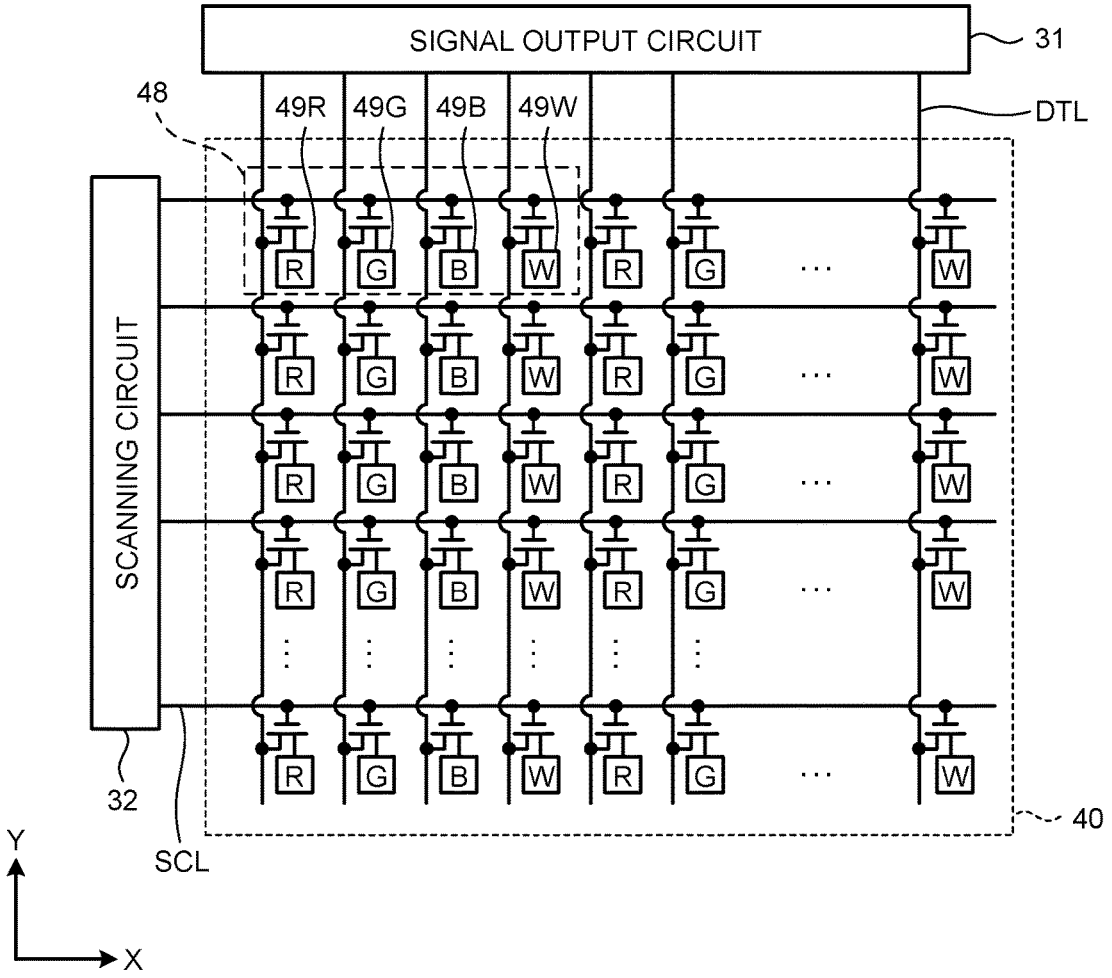
FIG. 2 is a conceptual diagram of an image display panel according to the first embodiment.

FIG. 1 is a block diagram of an exemplary configuration of a display device according to a first embodiment. FIG. 2 is a conceptual diagram of an image display panel according to the first embodiment. As illustrated in FIG. 1, a display device 10 according to the first embodiment includes a signal processing unit 20, an image-display-panel driving unit 30, an image display panel 40, and a light source unit 50. The signal processing unit 20 receives input signals (RGB data) from a control device 11 provided outside the display device 10. The signal processing unit 20 then performs predetermined data conversion on the input signals and transmits the generated signals to respective units of the display device 10. The image-display-panel driving unit 30 controls the drive of the image display panel 40 based on the signals transmitted from the signal processing unit 20. The image display panel 40 displays an image based on signals transmitted from the image-display-panel driving unit 30. The display device 10 is a reflective liquid-crystal display device that displays an image by reflecting external light with the image display panel 40. When being used in an environment with insufficient external light, such as outdoors at night and in a dark place, the display device 10 displays an image by reflecting light emitted from the light source unit 50 with the image display panel 40.

Configuration of the Image Display Panel

The following describes the configuration of the image display panel 40. As illustrated in FIGS. 1 and 2, the image display panel 40 includes $P_0 \times Q_0$ pixels 48 ($P_0$ in the row direction and $Q_0$ in the column direction) arrayed in a two-dimensional matrix (rows and columns).

The pixels 48 each include a first sub-pixel 49R, a second sub-pixel 49G, a third sub-pixel 49B, and a fourth sub-pixel 49W. The first sub-pixel 49R displays a first color (e.g., red). The second sub-pixel 49G displays a second color (e.g., green). The third sub-pixel 49B displays a third color (e.g., blue). The fourth sub-pixel 49W displays a fourth color (e.g., white). The first, the second, the third, and the fourth colors are not limited to red, green, blue, and white, respectively, and simply need to be different from one another, such as complementary colors. The fourth sub-pixel 49W that displays the fourth color preferably has higher luminance than that of the first sub-pixel 49R that displays the first color, the second sub-pixel 49G that displays the second color, and the third sub-pixel 49B that displays the third color when the four sub-pixels are irradiated with the same quantity of light from light source. In the following description, the first sub-pixel 49R, the second sub-pixel 49G, the third sub-pixel 49B, and the fourth sub-pixel 49W will be referred to as a sub-pixel 49 when they need not be distinguished from one another. To specify a sub-pixel in a manner distinguished by its position in the array, the fourth sub-pixel in a pixel $\mathbf{48}_{(p,q)}$, for example, is referred to as a fourth sub-pixel $\mathbf{49}W_{(p,q)}$.

The image display panel 40 is a color liquid-crystal display panel. A first color filter is arranged between the first sub-pixel 49R and an image observer and causes the first color to pass therethrough. A second color filter is arranged between the second sub-pixel 49G and the image observer and causes the second color to pass therethrough. A third color filter is arranged between the third sub-pixel 49B and the image observer and causes the third color to pass therethrough. The image display panel 40 has no color filter between the fourth sub-pixel 49W and the image observer. The fourth sub-pixel 49W may be provided with a transparent resin layer instead of a color filter. Providing a transparent resin layer to the image display panel 40 can suppress the occurrence of a large gap above the fourth sub-pixel 49W, otherwise a large gap occurs because no color filter is provided to the fourth sub-pixel 49W.

Figure 3:
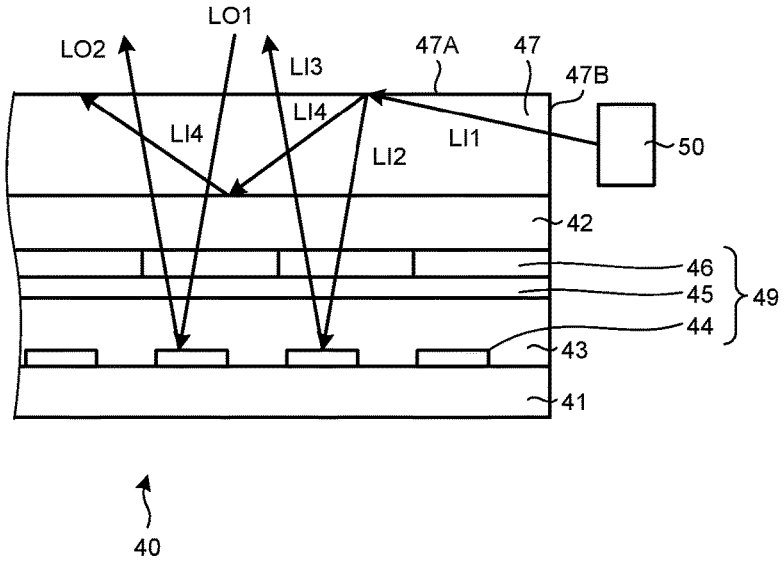
FIG. 3 is a sectional view schematically illustrating the structure of the image display panel according to the first embodiment.

FIG. 3 is a sectional view schematically illustrating the structure of the image display panel according to the first embodiment. The image display panel 40 is a reflective liquid-crystal display panel. As illustrated in FIG. 3, the image display panel 40 includes an array substrate 41, a counter substrate 42, and a liquid-crystal layer 43. The array substrate 41 and the counter substrate 42 face each other. The liquid-crystal layer 43 includes liquid-crystal elements and is provided between the array substrate 41 and the counter substrate 42.

The array substrate 41 includes a plurality of pixel electrodes 44 on a surface facing the liquid-crystal layer 43. The pixel electrodes 44 are coupled to signal lines DTL via respective switching elements and supplied with image output signals serving as video signals. The pixel electrodes 44 each are a reflective member made of aluminum or silver, for example, and reflect external light and/or light emitted from the light source unit 50. In other words, the pixel electrodes 44 serve as a reflection unit according to the first embodiment. The reflection unit reflects light entering from a front surface (surface on which an image is displayed) of the image display panel 40, thereby displaying an image.

The counter substrate 42 is a transparent substrate, such as a glass substrate. The counter substrate 42 includes a counter electrode 45 and color filters 46 on a surface facing the liquid-crystal layer 43. More specifically, the counter electrode 45 is provided on the surface of the color filters 46 facing the liquid-crystal layer 43.

The counter electrode 45 is made of a transparent conductive material, such as indium tin oxide (ITO) or indium zinc oxide (IZO). The pixel electrodes 44 and the counter electrode 45 are provided facing each other. Therefore, when a voltage of the image output signal is applied to between the pixel electrode 44 and the counter electrode 45, the pixel electrode 44 and the counter electrode 45 generate an electric field in the liquid-crystal layer 43. The electric field generated in the liquid-crystal layer 43 changes the birefringence index in the display device 10, thereby adjusting the quantity of light reflected by the image display panel 40. The image display panel 40 is what is called a longitudinal electric-field mode panel but may be a lateral electric-field mode panel that generates an electric field in a direction parallel to the display surface of the image display panel 40.

The color filters 46 are provided correspondingly to the respective pixel electrodes 44. Each of the pixel electrodes 44, the counter electrode 45, and corresponding one of the color filters 46 constitute a sub-pixel 49. A light guide plate 47 is provided on the surface of the counter substrate 42 opposite to the liquid-crystal layer 43. The light guide plate 47 is a transparent plate-like member made of an acrylic resin, a polycarbonate (PC) resin, or a methyl methacrylate-styrene copolymer (MS resin), for example. Prisms are formed on an upper surface 47A of the light guide plate 47, which is a surface opposite to the counter substrate 42.

Configuration of the Light Source Unit 50

The light source unit 50 according to the first embodiment includes light-emitting diodes (LEDs). As illustrated in FIG. 3, the light source unit 50 is provided along a side surface 47B of the light guide plate 47. The light source unit 50 irradiates the image display panel 40 with light from the front surface of the image display panel 40 through the light guide plate 47. The light source unit 50 is switched on (lighting-up) and off (lighting-out) by an operation performed by the image observer or an external light sensor mounted on the display device 10 to measure external light, for example. The light source unit 50 emits light when being on and does not emit light when being off. When the image observer feels an image is dark, for example, the image observer turns on the light source unit 50 to irradiate the image display panel 40 with light, thereby brightening the image. Alternatively, when the external light sensor determines that the intensity of external light is lower than a predetermined value, the signal processing unit 20, for example, turns on the light source unit 50 to irradiate the image display panel 40 with light, thereby brightening the image. The signal processing unit 20 according to the first embodiment controls the luminance of light of the light source unit 50 not based on an extension coefficient (expansion coefficient) α. In other words, the luminance of light of the light source unit 50 is set independently of the extension coefficient α, which will be described later. The luminance of light of the light source unit 50, however, may be adjusted by an operation performed by the image observer or a measurement result of the external light sensor.

The following describes reflection of light by the image display panel 40. As illustrated in FIG. 3, external light LO1 enters the image display panel 40. The external light LO1 is incident on the pixel electrode 44 through the light guide plate 47 and the image display panel 40. The external light LO1 incident on the pixel electrode 44 is reflected by the pixel electrode 44 and output, as light LO2, to the outside through the image display panel 40 and the light guide plate 47. When the light source unit 50 is turned on, light LI1 emitted from the light source unit 50 enters the light guide plate 47 through the side surface 47B of the light guide plate 47. The light LI1 entering the light guide plate 47 is scattered and reflected on the upper surface 47A of the light guide plate 47. A part of the light enters, as light LI2, the image display panel 40 from the counter substrate 42 side of the image display panel 40 and is projected onto the pixel electrode 44. The light LI2 projected onto the pixel electrode 44 is reflected by the pixel electrode 44 and output, as light LI3, to the outside through the image display panel 40 and the light guide plate 47. The other part of the light scattered on the upper surface 47A of the light guide plate 47 is reflected as light LI4 and repeatedly reflected in the light guide plate 47.

In other words, the pixel electrodes 44 reflect the external light LO1 and the light LI2 toward the outside, the external light LO1 entering the image display panel 40 through the front surface serving as the external side (counter substrate 42 side) surface of the image display panel 40. The light LO2 and the light LI3 reflected toward the outside pass through the liquid-crystal layer 43 and the color filters 46. Thus, the display device 10 can display an image with the light LO2 and the light LI3 reflected toward the outside. As described above, the display device 10 according to the first embodiment is a reflective display device serving as a front-light type display device and including the edge-light type light source unit 50. While the display device 10 according to the first embodiment includes the light source unit 50 and the light guide plate 47, it does not necessarily include the light source unit 50 or the light guide plate 47. In this case, the display device 10 can display an image with the light LO2 obtained by reflecting the external light LO1.

Configuration of the Signal Processing Unit

The following describes the configuration of the signal processing unit 20. The signal processing unit 20 processes an input signal received from the control device 11, thereby generating an output signal. The signal processing unit 20 converts an input value of the input signal to be displayed by combining red (first color), green (second color), and blue (third color) into an extended (expanded) value in an extended (expanded) color space such as HSV (Hue-Saturation-Value, Value is also called Brightness) color space in the first embodiment, the extended value serving as an output signal. The extended color space is extended (expanded) by red (first color), green (second color), blue (third color), and white (fourth color). The signal processing unit 20 outputs the generated output signal to the image-display-panel driving unit 30. The extended color space will be described later. While the extended color space according to the first embodiment is the HSV color space, it is not limited thereto. The extended color space may be another coordinate system, such as the XYZ color space and the YUV color space.

Figure 4:
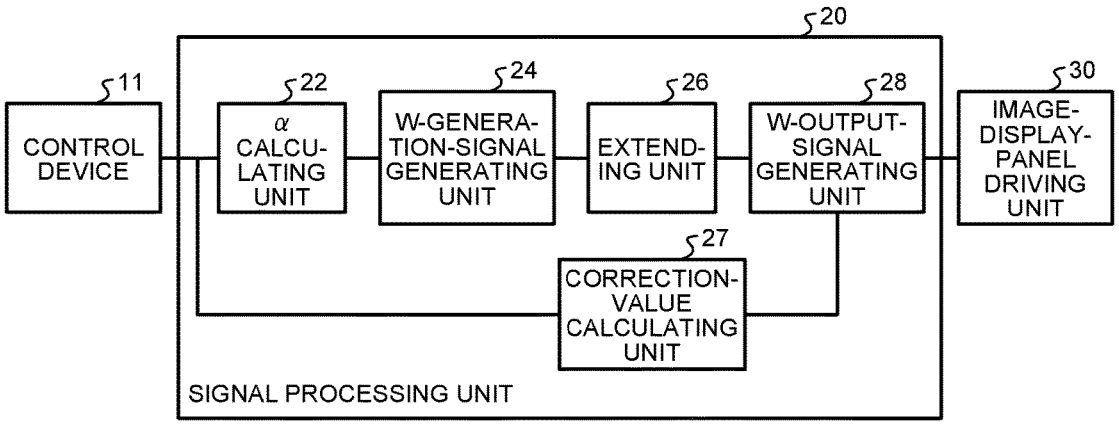
FIG. 4 is a block diagram of a schematic configuration of a signal processing unit according to the first embodiment.

FIG. 4 is a block diagram of a schematic configuration of the signal processing unit according to the first embodiment. As illustrated in FIG. 4, the signal processing unit 20 includes an α calculating unit 22, a W-generation-signal generating unit 24, an extending (expanding) unit 26, a correction-value calculating unit 27, and a W-output-signal generating unit 28.

The α calculating unit 22 acquires an input signal from the control device 11. Based on the acquired input signal, the a calculating unit 22 calculates the extension coefficient α. The calculation of the extension coefficient α performed by the α calculating unit 22 will be described later.

The W-generation-signal generating unit 24 acquires the signal value of the input signal and the value of the extension coefficient α from the α calculating unit 22. Based on the acquired input signal and the acquired extension coefficient α, the W-generation-signal generating unit 24 generates a generation signal for the fourth sub-pixel 49W. The generation of the generation signal for the fourth sub-pixel 49W performed by the W-generation-signal generating unit 24 will be described later.

The extending unit 26 acquires the signal value of the input signal, the value of the extension coefficient α, and the generation signal for the fourth sub-pixel 49W from the W-generation-signal generating unit 24. Based on the acquired signal value of the input signal, the acquired value of the extension coefficient α, and the acquired generation signal for the fourth sub-pixel 49W, the extending unit 26 performs extension. Thus, the extending unit 26 generates an output signal for the first sub-pixel 49R, an output signal for the second sub-pixel 49G, and an output signal for the third sub-pixel 49B. The extension performed by the extending unit 26 will be described later.

The correction-value calculating unit 27 acquires the signal value of the input signal from the control device 11. Based on the acquired signal value of the input signal, the correction-value calculating unit 27 calculates a hue of an input color to be displayed based on at least the input signal. Based on at least the hue of the input color, the correction-value calculating unit 27 calculates a correction value for deriving an output signal for the fourth sub-pixel. The calculation of the correction value performed by the correction-value calculating unit 27 will be described later. While the correction-value calculating unit 27 acquires the signal value of the input signal directly from the control device 11, the configuration is not limited thereto. The correction-value calculating unit 27 may acquire the signal value of the input signal from another unit in the signal processing unit 20, such as the α calculating unit 22, the W-generation-signal generating unit 24, or the extending unit 26.

The W-output-signal generating unit 28 acquires the signal value of the generation signal for the fourth sub-pixel 49W from the extending unit 26 and acquires the correction value from the correction-value calculating unit 27. Based on the acquired signal value of the generation signal for the fourth sub-pixel and the acquired correction value, the W-output-signal generating unit 28 generates an output signal for the fourth sub-pixel 49W and outputs it to the image-display-panel driving unit 30. The generation of the output signal for the fourth sub-pixel 49W performed by the W-output-signal generating unit 28 will be described later. The W-output-signal generating unit 28 acquires the output signal for the first sub-pixel 49R, the output signal for the second sub-pixel 49G, and the output signal for the third sub-pixel 49B from the extending unit 26 and outputs them to the image-display-panel driving unit 30. Alternatively, the extending unit 26 may output the output signal for the first sub-pixel 49R, the output signal for the second sub-pixel 49G, and the output signal for the third sub-pixel 49B directly to the image-display-panel driving unit 30.

Configuration of the Image Display Panel Driving Unit

As illustrated in FIGS. 1 and 2, the image-display-panel driving unit 30 includes a signal output circuit 31 and a scanning circuit 32. In the image-display-panel driving unit 30, the signal output circuit 31 holds video signals and sequentially outputs them to the image display panel 40. More specifically, the signal output circuit 31 outputs image output signals having certain electric potentials corresponding to the output signals from the signal processing unit 20 to the image display panel 40. The signal output circuit 31 is electrically coupled to the image display panel 40 through signal lines DTL. The scanning circuit 32 controls on and off of each switching element (for example, TFT) for controlling an operation (optical transmittance) of the sub-pixel 49 in the image display panel 40. The scanning circuit 32 is electrically coupled to the image display panel 40 through wiring SCL.

Processing Operation of the Display Device

Figure 5:
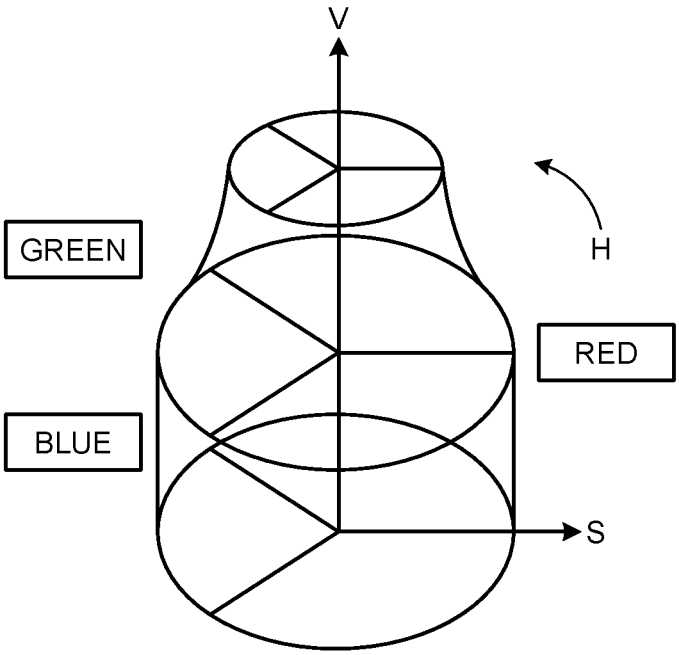
FIG. 5 is a conceptual diagram of an extended (expanded) HSV color space that can be output by the display device according to the present embodiment.
Figure 6:
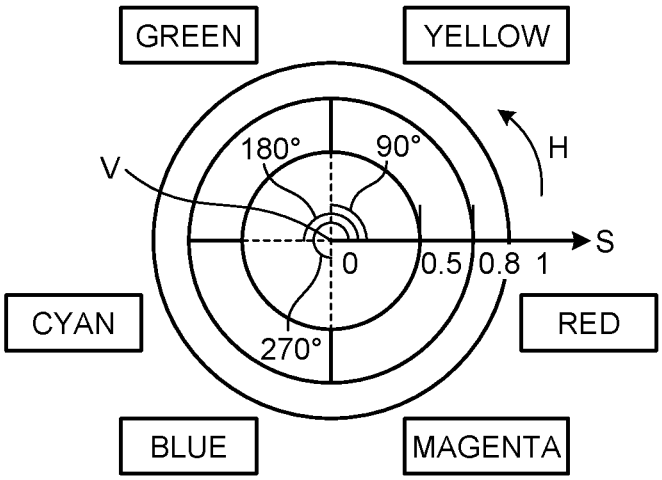
FIG. 6 is a conceptual diagram of the relation between a hue and saturation in the extended HSV color space.

The following describes a processing operation of the display device 10. FIG. 5 is a conceptual diagram of the extended HSV color space that can be output by the display device according to the present embodiment. FIG. 6 is a conceptual diagram of a relation between a hue and saturation in the extended HSV color space.

The signal processing unit 20 receives an input signal serving as information on an image to be displayed from the control device 11. The input signal includes information on an image (color) to be displayed at a corresponding position in each pixel as an input signal. Specifically, the signal processing unit 20 receives, for the (p,q)-th pixel (where $1 \leq p \leq T$ and $1 \leq q \leq Q_0$ are satisfied), a signal including an input signal for the first sub-pixel having a signal value of $x_{1-(p,q)}$, an input signal for the second sub-pixel having a signal value of $x_{2-(p,q)}$, and an input signal for the third sub-pixel having a signal value of $x_{3-(p,q)}$.

The signal processing unit 20 processes the input signal, thereby generating an output signal for the first sub-pixel (signal value $X_{1-(p,q)}$) for determining a display gradation of the first sub-pixel 49R, an output signal for the second sub-pixel (signal value $X_{2-(p,q)}$) for determining a display gradation of the second sub-pixel 49G, and an output signal for the third sub-pixel (signal value $x_{-(p,q)}$ for determining a display gradation of the third sub-pixel 49B. The signal processing unit 20 then outputs the output signals to the image-display-panel driving unit 30. Processing the input signal by the signal processing unit 20 also generates a generation signal for the fourth sub-pixel 49W (signal value $XA_{4-(p,q)}$). Based on the generation signal for the fourth sub-pixel 49W (signal value $XA_{4-(p,q)}$) and a correction value k, the signal processing unit 20 generates an output signal for the fourth sub-pixel (signal value $X_{4-(p,q)}$) for determining a display gradation of the fourth sub-pixel 49W and outputs it to the image-display-panel driving unit 30.

In the display device 10, the pixels 48 each include the fourth sub-pixel 49W that outputs the fourth color (white) to broaden the dynamic range of brightness in the extended color space (HSV color space in the first embodiment) as illustrated in FIG. 5. Specifically, the extended color space that can be output by the display device 10 has the shape illustrated in FIG. 5: a solid having a substantially truncated-cone-shaped section along the saturation axis and the brightness axis with curved oblique sides is placed on a cylindrical color space displayable by the first sub-pixel 49R, the second sub-pixel 49G, and the third sub-pixel 49B. The curved oblique sides indicate that the maximum value of the brightness decreases as the saturation increases. The signal processing unit 20 stores therein the maximum value Vmax (S) of the brightness in the extended (expanded) color space (HSV color space in the first embodiment) extended (expanded) by adding the fourth color (white). The variable of the maximum value Vmax(S) is saturation S. In other words, the signal processing unit 20 stores therein the maximum value Vmax(S) of the brightness for each pair of coordinates (coordinate values) of the saturation and the hue with respect to the three-dimensional shape of the extended color space illustrated in FIG. 5. Because the input signal includes the input signals for the first sub-pixel 49R, the second sub-pixel 49G, and the third sub-pixel 49B, the color space of the input signal has a cylindrical shape, that is, the same shape as the cylindrical part of the extended color space.

The following describes the processing operation of the signal processing unit 20 in greater detail. Based on input signal values for the sub-pixels 49 in a plurality of pixels 48, the α calculating unit 22 of the signal processing unit 20 derives the saturation S and brightness V(S) of input colors in the pixels 48, thereby calculating the extension coefficient α. The input color is a color displayed based on the input signal values for the sub-pixels 49. In other words, the input color is a color displayed in each pixel 48 when no processing is performed on the input signals by the signal processing unit 20.

The saturation S and the brightness V(S) are expressed as follows: S=(Max−Min)/Max, and V(S)=Max. The saturation S takes values of 0 to 1, and the brightness V(S) takes values of 0 to $(2^n-1)$, where n is the number of bits of the display gradation. Max is the maximum value of the input signal values for the three sub-pixels in a pixel, that is, of the input signal value for the first sub-pixel 49R, the input signal value for the second sub-pixel 49G, and the input signal value for the third sub-pixel 49B. Min is the minimum value of the input signal values for the three sub-pixels in the pixel, that is, of the input signal value for the first sub-pixel 49R, the input signal value for the second sub-pixel 49G, and the input signal value for the third sub-pixel 49B.

In the (p,q)-th pixel, the saturation $S_{(p,q)}$ and the brightness $V(S)_{(p,q)}$ of the input color in the cylindrical HSV color space are typically derived by the following Equations (1) and (2) based on the input signal for the first sub-pixel (signal value $x_{1-(p,q)}$), the input signal for the second sub-pixel (signal value $x_{2-(p,q)}$, and the input signal for the third sub-pixel (signal value $x_{3-(p,q)}$.

$$S_{(p,q)}=(\mathrm{Max}_{(p,q)}-\mathrm{Min}_{(p,q)})/\mathrm{Max}_{(p,q)} \quad (1)$$

$$V(S)_{(p,q)}=\mathrm{Max}_{(p,q)} \quad (2)$$

$\mathrm{Max}_{(p,q)}$ is the maximum value of the input signal values ($x_{1-(p,q)}$, $x_{2-(p,q)}$, and $x_{3-(p,q)}$) for the three sub-pixels 49, and $\mathrm{Min}_{(p,q)}$ is the minimum value of the input signal values ($x_{1-(p,q)}$, $x_{2-(p,q)}$, and $x_{3-(p,q)}$) for the three sub-pixels 49. In the first embodiment, n is 8. In other words, the number of bits of the display gradation is 8 (the value of the display gradation is 256 from 0 to 255). The α calculating unit 22 may calculate the saturation S alone and does not necessarily calculate the brightness V(S).

Figure 7:
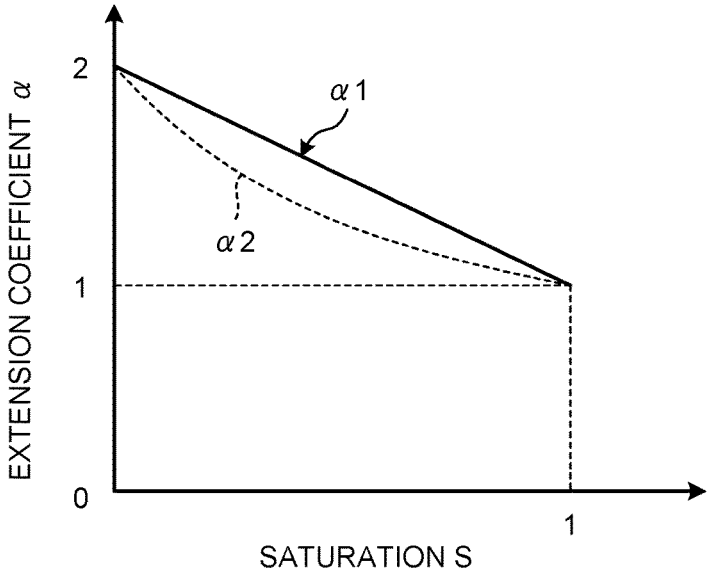
FIG. 7 is a graph of a relation between saturation and an extension coefficient (expansion coefficient) according to the first embodiment.

The α calculating unit 22 of the signal processing unit 20 calculates the extension coefficients α for the respective pixels 48 in one frame. The extension coefficient α is set for each pixel 48. The signal processing unit 20 calculates the extension coefficient α such that the value of the extension coefficient α varies depending on the saturation S of the input color. More specifically, the signal processing unit 20 calculates the extension coefficient α such that the value of the extension coefficient α decreases as the saturation S of the input color increases. FIG. 7 is a graph of the relation between the saturation and the extension coefficient according to the first embodiment. The abscissa in FIG. 7 indicates the saturation S of the input color, and the ordinate indicates the extension coefficient α. As indicated by the line segment α1 in FIG. 7, the signal processing unit 20 sets the extension coefficient α to 2 when the saturation S is 0, decreases the extension coefficient α as the saturation S increases, and sets the extension coefficient α to 1 when the saturation S is 1. As indicated by the line segment α1 in FIG. 7, the extension coefficient α linearly decreases as the saturation increases. The signal processing unit 20, however, does not necessarily calculate the extension coefficient α based on the line segment α1. The signal processing unit 20 simply needs to calculate the extension coefficient α such that the value of the extension coefficient α decreases as the saturation S of the input color increases. As indicated by the line segment α2 in FIG. 7, for example, the signal processing unit 20 may calculate the extension coefficient α such that the value of the extension coefficient α decreases in a quadratic curve manner as the saturation increases. When the saturation S is 0, the extension coefficient α is not necessarily set to 2 and may be set to a desired value by settings based on the luminance of the fourth sub-pixel 49W, for example. The signal processing unit 20 may set the extension coefficient α to a fixed value independently of the saturation of the input color.

Subsequently, the W-generation-signal generating unit 24 of the signal processing unit 20 calculates the generation signal value $XA_{4-(p,q)}$ for the fourth sub-pixel based on at least the input signal for the first sub-pixel (signal value $x_{1-(p,q)}$), the input signal for the second sub-pixel (signal value $x_{2-(p,q)}$), and the input signal for the third sub-pixel (signal value $x_{3-(p,q)}$). More specifically, the W-generation-signal generating unit 24 of the signal processing unit 20 derives the generation signal value $XA_{4-(p,q)}$ for the fourth sub-pixel based on the product of $\mathrm{Min}_{(p,q)}$ and the extension coefficient α of the pixel $\mathbf{48}_{(p,q)}$. Specifically, the signal processing unit 20 derives the generation signal value $XA_{4-(p,q)}$ based on the following Equation (3). While the product of $\mathrm{Min}_{(p,q)}$ and the extension coefficient α is divided by χ in Equation (3), the embodiment is not limited thereto.

$$XA_{4-(p,q)}=\mathrm{Min}_{(p,q)}\cdot\alpha/\chi \quad (3)$$

χ x is a constant depending on the display device 10. The fourth sub-pixel 49W that displays white is provided with no color filter. The fourth sub-pixel 49W that displays the fourth color is brighter than the first sub-pixel 49R that displays the first color, the second sub-pixel 49G that displays the second color, and the third sub-pixel 49B that displays the third color when the four sub-pixels are irradiated with the same quantity of light from the light source. Let us assume a case where $BN_{1-3}$ denotes the luminance of an aggregate of the first sub-pixel 49R, the second sub-pixel 49G, and the third sub-pixel 49B in a pixel 48 or a group of pixels 48 when the first sub-pixel 49R receives a signal having a value corresponding to the maximum signal value of the output signals for the first sub-pixel 49R, the second sub-pixel 49G receives a signal having a value corresponding to the maximum signal value of the output signals for the second sub-pixel 49G, and the third sub-pixel 49B receives a signal having a value corresponding to the maximum signal value of the output signals for the third sub-pixel 49B. Let us also assume a case where $BN_4$ denotes the luminance of the fourth sub-pixel 49W when the fourth sub-pixel 49W in the pixel 48 or the group of pixels 48 receives a signal having a value corresponding to the maximum signal value of the output signals for the fourth sub-pixel 49W. In other words, the aggregate of the first sub-pixel 49R, the second sub-pixel 49G, and the third sub-pixel 49B displays white having the highest luminance. The luminance of white is denoted by $BN_{1-3}$. Assume χ is a constant depending on the display device 10, the constant χ is expressed by: $\chi=BN_4/BN_{1-3}$.

Specifically, the luminance $BN_4$ when an input signal having a value of display gradation of 255 is assumed to be supplied to the fourth sub-pixel 49W is, for example, 1.5 times the luminance $BN_{1-3}$ of white when input signals having the following values of display gradation are supplied to the aggregate of the first sub-pixels 49R, the second sub-pixels 49G, and the third sub-pixels 49B: the signal value $x_{1-(p,q)}$=255, the signal value $x_{2-(p,q)}$=255, and the signal value $x_{3-(p,q)}$=255. That is, $\chi$=1.5 in the first embodiment.

Subsequently, the extending unit 26 of the signal processing unit 20 calculates the output signal for the first sub-pixel (signal value $X_{1-(p,q)}$ based on at least the input signal for the first sub-pixel (signal value $x_{1-(p,q)}$ and the extension coefficient $\alpha$ of the pixel $\mathbf{48}_{(p,q)}$. The extending unit 26 also calculates the output signal for the second sub-pixel (signal value $X_{2-(p,q)}$ based on at least the input signal for the second sub-pixel (signal value $x_{2-(p,q)}$) and the extension coefficient $\alpha$ of the pixel $\mathbf{48}_{(p,q)}$. The extending unit 26 also calculates the output signal for the third sub-pixel (signal value $X_{3-(p,q)}$ based on at least the input signal for the third sub-pixel (signal value $x_{3-(p,q)}$) and the extension coefficient $\alpha$ of the pixel $\mathbf{48}_{(p,q)}$.

Specifically, the signal processing unit 20 calculates the output signal for the first sub-pixel 49R based on the input signal for the first sub-pixel 49R, the extension coefficient $\alpha$, and the generation signal for the fourth sub-pixel 49W. The signal processing unit 20 also calculates the output signal for the second sub-pixel 49G based on the input signal for the second sub-pixel 49G, the extension coefficient $\alpha$, and the generation signal for the fourth sub-pixel 49W. The signal processing unit 20 also calculates the output signal for the third sub-pixel 49B based on the input signal for the third sub-pixel 49B, the extension coefficient $\alpha$, and the generation signal for the fourth sub-pixel 49W.

Specifically, assume $\chi$ is a constant depending on the display device, the signal processing unit 20 derives the output signal value $X_{1-(p,q)}$ for the first sub-pixel, the output signal value $X_{2-(p,q)}$ for the second sub-pixel, and the output signal value $X_{3-(p,q)}$ for the third sub-pixel to be supplied to the (p,q)-th pixel (or a group of the first sub-pixel 49R, the second sub-pixel 49G, and the third sub-pixel 49B) using the following Equations (4) to (6).

$$X_{1-(p,q)}=\alpha\cdot x_{1-(p,q)}-\chi\cdot XA_{4-(p,q)} \tag{4}$$

$$X_{2-(p,q)}=\alpha\cdot x_{2-(p,q)}-\chi\cdot XA_{4-(p,q)} \tag{5}$$

$$X_{3-(p,q)}=\alpha\cdot x_{3-(p,q)}-\chi\cdot XA_{4-(p,q)} \tag{6}$$

The correction-value calculating unit 27 of the signal processing unit 20 calculates the correction value k used to generate the output signal for the fourth sub-pixel 49W. The correction value k is derived based on at least the hue of the input color, and more specifically on the hue and the saturation of the input color. Still more specifically, the correction-value calculating unit 27 of the signal processing unit 20 calculates a first correction term k1 based on the hue of the input color and a second correction term k2 based on the saturation of the input color. Based on the first correction term k1 and the second correction term k2, the signal processing unit 20 calculates the correction value k.

Figure 8:
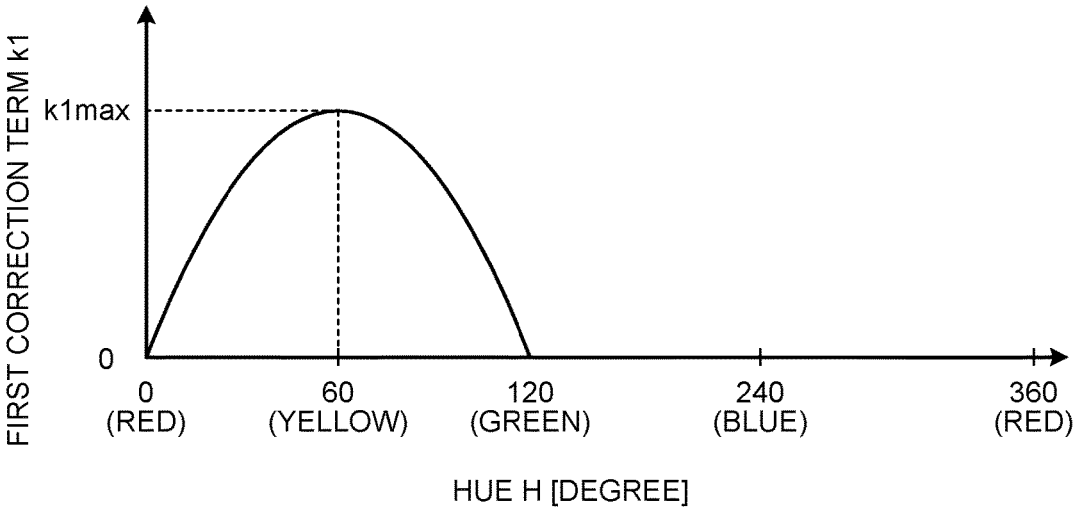
FIG. 8 is a graph of a relation between the hue of an input color and a first correction term according to the first embodiment.

The following describes calculation of the first correction term k1. FIG. 8 is a graph of a relation between the hue of the input color and the first correction term according to the first embodiment. The abscissa in FIG. 8 indicates the hue H of the input color, and the ordinate indicates the value of the first correction term k1. As illustrated in FIG. 6, the hue H is represented in the range from 0° to 360°. The hue H varies in order of red, yellow, green, cyan, blue, magenta, and red from 0° to 360°. In the first embodiment, a region including 0° and 360° corresponds to red, a region including 120° corresponds to green, and a region including 240° corresponds to blue. A region including 60° corresponds to yellow.

As illustrated in FIG. 8, the first correction term k1 calculated by the signal processing unit 20 increases as the hue of the input color is closer to yellow (predetermined hue) at 60°. The first correction term k1 is 0 when the hue of the input color is red (first hue) at 0° and green (second hue) at 120°. The first correction term k1 increases as the hue of the input color is closer from red at 0° to yellow at 60° and increases as the hue of the input color is closer from green at 120° to yellow at 60°. The first correction term k1 is the maximum value $\mathbf{K1}_{max}$ when the hue of the input color is yellow at 60°. The first correction term k1 is 0 when the hue of the input color falls within a range out of a range larger than 0° and smaller than 120°, that is, within the range of 120° to 360°. The value $\mathbf{K1}_{max}$ is set to a desired value.

Specifically, assume the hue of the input color for the (p,q)-th pixel is $H_{(p,q)}$, the signal processing unit 20 calculates a first correction term $k1_{(p,q)}$ for the (p,q)-th pixel using the following Equation (7).

$$k1_{(p,q)}=k1_{max}-k1_{max}\cdot(H_{(p,q)}-60)^2/3600 \tag{7}$$

The hue $H_{(p,q)}$ is calculated by the following Equation (8). When $\mathbf{k1}_{(p,q)}$ is a negative value in Equation (7), $\mathbf{k1}_{(p,q)}$ is determined to be 0.

$$H=\begin{cases} \text{undefinded}, & \text{if } \mathrm{Min}_{(p,q)}=\mathrm{Max}_{(p,q)} \\ 60\times\dfrac{x_{2-(p,q)}-x_{1-(p,q)}}{\mathrm{Max}_{(p,q)}-\mathrm{Min}_{(p,q)}}+60, & \text{if } \mathrm{Min}_{(p,q)}=x_{3-(p,q)} \\ 60\times\dfrac{x_{3-(p,q)}-x_{2-(p,q)}}{\mathrm{Max}_{(p,q)}-\mathrm{Min}_{(p,q)}}+180, & \text{if } \mathrm{Min}_{(p,q)}=x_{1-(p,q)} \\ 60\times\dfrac{x_{1-(p,q)}-x_{3-(p,q)}}{\mathrm{Max}_{(p,q)}-\mathrm{Min}_{(p,q)}}+300, & \text{if } \mathrm{Min}_{(p,q)}=x_{2-(p,q)} \end{cases} \tag{8}$$

While the signal processing unit 20 derives the first correction term k1 as described above, the method for calculating the first correction term k1 is not limited thereto. While the first correction term k1 increases in a quadratic curve manner as the hue of the input color is closer to yellow at 60°, for example, the embodiment is not limited thereto. The first correction term k1 simply needs to increase as the hue of the input color is closer to yellow at 60° and may linearly increase, for example. While the first correction term k1 takes the maximum value only when the hue is yellow at 60°, it may take the maximum value when the hue falls within a predetermined range. While the hue in which the first correction term k1 takes the maximum value is preferably yellow at 60°, the hue is not limited thereto and may be a desired one. The hue in which the first correction term k1 takes the maximum value preferably falls within a range between red at 0° and green at 120°, for example. While the first hue is red at 0°, and the second hue is green at 120°, the first and the second hues are not limited thereto and may be desired ones. The first and the second hues preferably fall within the range of 0° to 120°, for example.

Figure 9:
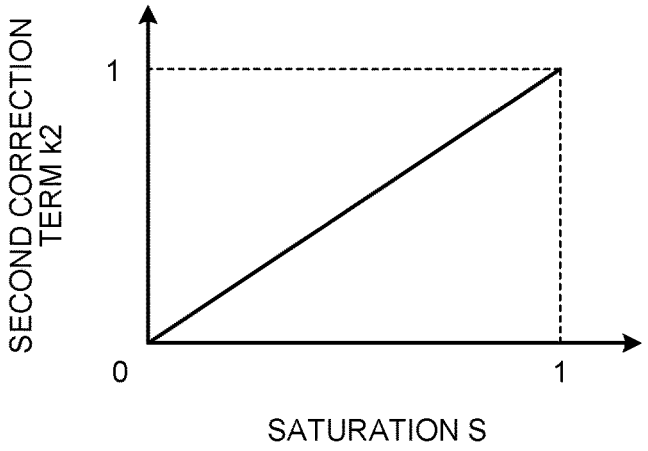
FIG. 9 is a graph of a relation between the saturation of the input color and a second correction term according to the first embodiment.

The following describes calculation of the second correction term k2. FIG. 9 is a graph of a relation between the saturation of the input color and the second correction term according to the first embodiment. The abscissa in FIG. 9 indicates the saturation S of the input color, and the ordinate indicates the value of the second correction term k2.

As illustrated in FIG. 9, the second correction term k2 calculated by the signal processing unit 20 increases as the saturation of the input color increases. More specifically, the second correction term k2 is 0 when the saturation of the input color is 0. The second correction term k2 is 1 when the saturation of the input color is 1. The second correction term k2 linearly increases as the saturation of the input color increases. Specifically, the signal processing unit 20 calculates a second correction term $k2_{(p,q)}$ for the (p,q)-th pixel using the following Equation (9).

$$k2_{(p,q)}=S_{(p,q)} \tag{9}$$

The method for calculating the second correction term k2 performed by the signal processing unit 20 is not limited to the method described above. The second correction term k2 simply needs to increase as the saturation of the input color increases and may vary not linearly but in a quadratic curve manner, for example. The second correction term k2 simply needs to increase as the saturation of the input color increases, and the second correction term k2 is not necessarily 0 when the saturation of the input color is 0 or is not necessarily 1 when the saturation of the input color is 1.

The following describes calculation of the correction value k. The signal processing unit 20 calculates the correction value k based on the first correction term k1 and the second correction term k2. More specifically, the signal processing unit 20 calculates the correction value k by multiplying the first correction term k1 by the second correction term k2. The signal processing unit 20 calculates a correction value $k_{(p,q)}$ for the (p,q)-th pixel using the following Equation (10).

$$k_{(p,q)}=k1_{(p,q)}\cdot k2_{(p,q)} \tag{10}$$

The method for calculating the correction value k performed by the signal processing unit 20 is not limited to the method described above. The method simply needs to be a method for deriving the correction value k based on at least the first correction term k1.

Subsequently, the W-output-signal generating unit 28 of the signal processing unit 20 calculates the output signal value $X_{4-(p,q)}$ for the fourth sub-pixel based on the generation signal value $XA_{4-(p,q)}$ for the fourth sub-pixel and the correction value $k_{(p,q)}$. More specifically, the W-output-signal generating unit 28 of the signal processing unit 20 adds the correction value $k_{(p,q)}$ to the generation signal value $XA_{4-(p,q)}$ for the fourth sub-pixel, thereby calculating the output signal value $X_{4-(p,q)}$ for the fourth sub-pixel. Specifically, the signal processing unit 20 calculates the output signal value $X_{4-(p,q)}$ for the fourth sub-pixel using the following Equation (11).

$$X_{4-(p,q)}=XA_{4-(p,q)}+k_{(p,q)} \tag{11}$$

The method for calculating the output signal value $X_{4-(p,q)}$ for the fourth sub-pixel performed by the signal processing unit 20 simply needs to be a method for calculating it based on the generation signal value $XA_{4-(p,q)}$ for the fourth sub-pixel and the correction value $k_{(p,q)}$ and is not limited to Equation (11).

As described above, the signal processing unit 20 generates the output signal for each sub-pixel 49. The following describes a method for calculation (extension) of the signal values $X_{1-(p,q)}$, $X_{2-(p,q)}$, $X_{3-(p,q)}$, and $X_{4-(p,q)}$ serving as the output signals for the (p,q)-th pixel 48.

First Step

First, the signal processing unit 20 derives, based on input signal values for the sub-pixels 49 in a plurality of pixels 48, the saturation S of the pixels 48. Specifically, based on the signal value $x_{1-(p,q)}$ of the input signal for the first sub-pixel 49R, the signal value $x_{2-(p,q)}$ of the input signal for the second sub-pixel 49G, and the signal value $x_{3-(p,q)}$ of the input signal for the third sub-pixel 49B to be supplied to the (p,q)-th pixel 48, the signal processing unit 20 derives the saturation $S_{(p,q)}$ using Equation (1). The signal processing unit 20 performs the processing on all the $P_0\times Q_0$ pixels 48.

Second Step

Next, the signal processing unit 20 calculates the extension coefficient α based on the calculated saturation S in the pixels 48. Specifically, the signal processing unit 20 calculates the extension coefficients α of the respective $P_0\times Q_0$ pixels 48 in one frame based on the line segment α1 illustrated in FIG. 7 such that the extension coefficients α decrease as the saturation S of the input color increases.

Third Step

Subsequently, the signal processing unit 20 derives the generation signal value $XA_{4-(p,q)}$ for the fourth sub-pixel in the (p,q)-th pixel 48 based on at least the input signal value $x_{1-(p,q)}$ for the first sub-pixel, the input signal value $x_{2-(p,q)}$ for the second sub-pixel, and the input signal value $x_{3-(p,q)}$ for the third sub-pixel. The signal processing unit 20 according to the first embodiment determines the generation signal value $XA_{4-(p,q)}$ for the fourth sub-pixel based on $Min_{(p,q)}$, the extension coefficient α, and the constant χ. More specifically, the signal processing unit 20 derives the generation signal value $XA_{4-(p,q)}$ for the fourth sub-pixel based on Equation (3) as described above. The signal processing unit 20 derives the generation signal value $XA_{4-(p,q)}$ for the fourth sub-pixel for all the $P_0\times Q_0$ pixels 48.

Fourth Step

Subsequently, the signal processing unit 20 derives the output signal value $X_{1-(p,q)}$ for the first sub-pixel in the (p,q)-th pixel 48 based on the input signal value $x_{1-(p,q)}$ for the first sub-pixel, the extension coefficient α, and the generation signal value $XA_{4-(p,q)}$ for the fourth sub-pixel. The signal processing unit 20 also derives the output signal value $X_{2-(p,q)}$ for the second sub-pixel in the (p,q)-th pixel 48 based on the input signal value $x_{2-(p,q)}$ for the second sub-pixel, the extension coefficient α, and the generation signal value $XA_{4-(p,q)}$ for the fourth sub-pixel. The signal processing unit 20 also derives the output signal value $X_{3-(p,q)}$ for the third sub-pixel in the (p,q)-th pixel 48 based on the input signal value $x_{3-(p,q)}$ for the third sub-pixel, the extension coefficient α, and the generation signal value $XA_{4-(p,q)}$ for the fourth sub-pixel. Specifically, the signal processing unit 20 derives the output signal value $X_{1-(p,q)}$ for the first sub-pixel, the output signal value $X_{2-(p,q)}$ for the second sub-pixel, and the output signal value $X_{3-(p,q)}$ for the third sub-pixel in the (p,q)-th pixel 48 based on Equations (4) to (6).

Fifth Step

The signal processing unit 20 calculates the correction value $k_{(p,q)}$ for the (p,q)-th pixel 48 based on the first correction term $k1_{(p,q)}$ and the second correction term $k2_{(p,q)}$. More specifically, the signal processing unit 20 derives the first correction term $k1_{(p,q)}$ based on the hue of the input color for the (p,q)-th pixel 48 and derives the second correction term $k2_{(p,q)}$ based on the saturation of the input color for the (p,q)-th pixel 48. Specifically, the signal processing unit 20 calculates the first correction term $k1_{(p,q)}$ using Equation (7), calculates the second correction term $k2_{(p,q)}$ using Equation (9), and calculates the correction value $k_{(p,q)}$ using Equation (10).

Sixth Step

Subsequently, the signal processing unit 20 calculates the output signal $X_{4-(p,q)}$ for the fourth sub-pixel in the (p,q)-th pixel 48 based on the generation signal value $XA_{4-(p,q)}$ for the fourth sub-pixel and the correction value $k_{(p,q)}$. Specifically, the signal processing unit 20 calculates the output signal $X_{4-(p,q)}$ for the fourth sub-pixel using Equation (11).

Figure 10:
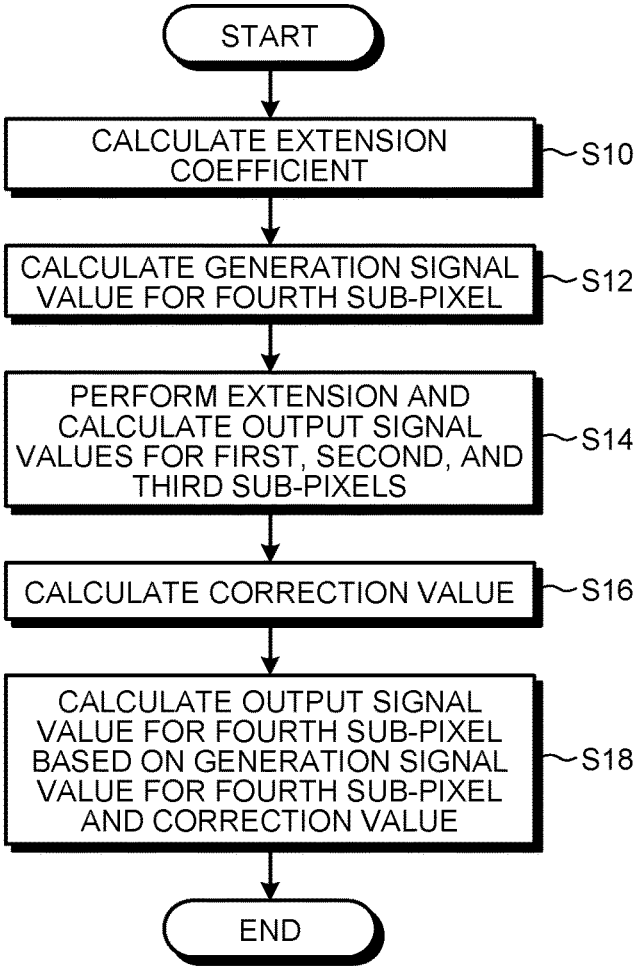
FIG. 10 is a flowchart for describing generation of output signals for respective sub-pixels performed by the signal processing unit according to the first embodiment.

The following describes generation of the output signals for the respective sub-pixels 49 performed by the signal processing unit 20 explained in the first to the sixth steps with reference to a flowchart. FIG. 10 is a flowchart for describing generation of the output signals for the respective sub-pixels performed by the signal processing unit according to the first embodiment.

As illustrated in FIG. 10, to generate the output signals for the respective sub-pixels 49, the αcalculating unit 22 of the signal processing unit 20 calculates the extension coefficient α for each of a plurality of pixels 48 based on the input signal received from the control device 11 (Step S10). Specifically, the signal processing unit 20 derives the saturation S of the input color using Equation (1). The signal processing unit 20 calculates the extension coefficients α of the respective $P_0 \times Q_0$ pixels 48 in one frame based on the line segment α1 illustrated in FIG. 7 such that the extension coefficients α decrease as the saturation S of the input color increases.

After calculating the extension coefficients α, the W-generation-signal generating unit 24 of the signal processing unit 20 calculates the generation signal value $XA_{4-(p,q)}$ for the fourth sub-pixel (Step S12). Specifically, the signal processing unit 20 derives the generation signal value $XA_{4-(p,q)}$ for the fourth sub-pixel based on $Min_{(p,q)}$, the extension coefficient α, and the constant χ using Equation (3).

After calculating the generation signal value $XA_{4-(p,q)}$ for the fourth sub-pixel, the extending unit 26 of the signal processing unit 20 performs extension, thereby calculating the output signal value $X_{1-(p,q)}$ for the first sub-pixel, the output signal value $X_{2-(p,q)}$ for the second sub-pixel, and the output signal value $X_{3-(p,q)}$ for the third sub-pixel (Step S14). Specifically, the signal processing unit 20 derives the output signal value $X_{1-(p,q)}$ for the first sub-pixel based on the input signal value $x_{1-(p,q)}$ for the first sub-pixel, the extension coefficient α, and the generation signal value $XA_{4-(p,q)}$ for the fourth sub-pixel using Equation (4). The signal processing unit 20 also derives the output signal value $X_{2-(p,q)}$ for the second sub-pixel based on the input signal value $x_{2-(p,q)}$ for the second sub-pixel, the extension coefficient α, and the generation signal value $XA_{4-(p,q)}$ for the fourth sub-pixel using Equation (5). The signal processing unit 20 also derives the output signal value $X_{3-(p,q)}$ for the third sub-pixel based on the input signal value $x_{3-(p,q)}$ for the third sub-pixel, the extension coefficient α, and the generation signal value $XA_{4-(p,q)}$ for the fourth sub-pixel using Equation (6).

After deriving the output signal value $X_{1-(p,q)}$ for the first sub-pixel, the output signal value $X_{2-(p,q)}$ for the second sub-pixel, and the output signal value $X_{3-(p,q)}$ for the third sub-pixel, the correction-value calculating unit 27 of the signal processing unit 20 calculates the correction value $k_{(p,q)}$ (Step S16). More specifically, the signal processing unit 20 derives the first correction term $k1_{(p,q)}$ based on the hue of the input color for the (p,q)-th pixel 48 and calculates the second correction term $k2_{(p,q)}$ based on the saturation of the input color for the (p,q)-th pixel 48. Specifically, the signal processing unit 20 calculates the first correction term $k1_{(p,q)}$ using Equation (7), calculates the second correction term $k2_{(p,q)}$ using Equation (9), and calculates the correction value $k_{(p,q)}$ using Equation (10). The calculation of the correction value $k_{(p,q)}$ at Step S16 simply needs to be performed before Step S18 and may be performed simultaneously with or before Step S10, S12, or S14.

After calculating the correction value $k_{(p,q)}$ and the generation signal value $XA_{4-(p,q)}$ for the fourth sub-pixel, the W-output-signal generating unit 28 of the signal processing unit 20 calculates the output signal value $X_{4-(p,q)}$ for the fourth sub-pixel based on the correction value $k_{(p,q)}$ and the generation signal value $XA_{4-(p,q)}$ for the fourth sub-pixel (Step S18). Specifically, the signal processing unit 20 calculates the output signal $X_{4-(p,q)}$ for the fourth sub-pixel using Equation (11). Thus, the signal processing unit 20 finishes the generation of the output signals for the respective sub-pixels 49.

As described above, the signal processing unit 20 calculates the output signal $X_{4-(p,q)}$ for the fourth sub-pixel based on the generation signal value $XA_{4-(p,q)}$ for the fourth sub-pixel and the correction value $k_{(p,q)}$. The generation signal value $XA_{4-(p,q)}$ for the fourth sub-pixel is obtained by extending the input signals for the first sub-pixel 49R, the second sub-pixel 49G, and the third sub-pixel 49B based on the extension coefficient α and converting them into a signal for the fourth sub-pixel 49W. The signal processing unit 20 calculates the output signal $X_{4-(p,q)}$ for the fourth sub-pixel based on the generation signal value $XA_{4-(p,q)}$ for the fourth sub-pixel calculated in this manner and the correction value $k_{(p,q)}$. The signal processing unit 20 calculates the correction value $k_{(p,q)}$ based on the hue of the input color. Thus, the display device 10, for example, can brighten a color with a hue having lower luminance based on the correction value $k_{(p,q)}$, thereby suppressing deterioration in the image.

In a case where two colors with different hues are displayed in one image, for example, one of the colors with a hue having lower luminance may possibly look darker because of simultaneous contrast. The signal processing unit 20 calculates the correction value k based on the hue of the input color. The signal processing unit 20 extends the output signal for the fourth sub-pixel based on the generation signal value $XA_{4-(p,q)}$ for the fourth sub-pixel and the correction value k (more specifically, the first correction term k1) calculated based on the hue. Thus, the display device 10 increases the brightness of the color with a hue having lower luminance, thereby preventing a certain color from looking darker because of simultaneous contrast. As a result, the display device 10 can suppress deterioration in the image.

The signal processing unit 20 adds the correction value $k_{(p,q)}$ to the generation signal value $XA_{4-(p,q)}$ for the fourth sub-pixel, thereby calculating the output signal $X_{4-(p,q)}$ for the fourth sub-pixel. In other words, the signal processing unit 20 adds the correction value $k_{(p,q)}$ to the generation signal value $XA_{4-(p,q)}$ for the fourth sub-pixel generated based on the input signals, thereby appropriately extending the output signal $X_{4-(p,q)}$ for the fourth sub-pixel. This increases the brightness of the color with a hue having lower luminance, thereby suppressing deterioration in the image.

When a color having a hue within the range from 0° to 120° looks darker, the deterioration in the image is likely to be recognized by the observer. Especially when a color having a hue closer to yellow at 60° looks darker, the deterioration in the image is likely to be recognized by the observer. The signal processing unit 20 increases the first correction term k1 as the hue of the input color is closer to a predetermined hue (yellow at 60° in the present embodiment) in which deterioration in the image is likely to be recognized by the observer. Thus, the display device 10 can more appropriately increase the brightness in the predetermined hue in which deterioration in the image is likely to be recognized by the observer. As a result, the display device 10 can prevent a color having a hue closer to the predetermined hue from looking darker because of simultaneous contrast. In a case where a pixel in a frame has a hue having the luminance higher than that of the predetermined hue, the signal processing unit 20 may extend the output signal for the fourth sub-pixel in the pixel with the predetermined hue based on the correction value k. Specifically, the signal processing unit 20 calculates the hue of the input color for each of all the pixels in a frame. In a case where a first pixel in the frame has the predetermined hue and a second pixel in the frame has a hue, such as white, having the luminance higher than that of the predetermined hue, the signal processing unit 20 may perform extension on the first pixel with the predetermined hue based on the correction value k. Furthermore, in a case where the first pixel with the predetermined hue is adjacent to the second pixel with a hue, such as white, having the luminance higher than that of the predetermined hue, the signal processing unit 20 may perform extension on the first pixel with the predetermined hue based on the correction value k.

The first correction term k1 is 0 when the hue of the input color falls within a range out of a range from the first hue (at 0°) to the second hue (at 120). Therefore, the signal processing unit 20 performs no extension based on the first correction term k1 in a range other than the range in which deterioration in the image is likely to be recognized by the observer. Thus, the display device 10 can more appropriately increase the brightness in the predetermined hue in which deterioration in the image is likely to be recognized by the observer. As a result, the display device 10 can prevent a color having a hue closer to the predetermined hue from looking darker because of simultaneous contrast. The predetermined hue is not limited to yellow at 60°, the first hue is not limited to red at 0°, or the second hue is not limited to green at 120°. These hues may be set to desired ones. Also in a case where the predetermined hue, the first hue, and the second hue are set to desired ones, the display device 10, for example, can brighten a color with a hue having lower luminance based on the correction value $k_{(p,q)}$. Thus, the display device 10 can suppress deterioration in the image.

The signal processing unit 20 calculates the correction value k also based on the saturation of the input color. More specifically, the signal processing unit 20 calculates the correction value k also based on the second correction term k2 that increases as the saturation of the input color increases. An increase in the saturation of the input color indicates that the input color is closer to a pure color. Deterioration in an image is more likely to be recognized in a pure color. The signal processing unit 20 increases the correction value k as the saturation of the input color increases. Thus, the display device 10 can more appropriately increase the brightness in high saturation in which deterioration in the image is likely to be recognized by the observer, thereby preventing a color from looking darker because of simultaneous contrast.

The display device 10 extends the input signals for all the pixels in one frame based on the extension coefficient α. In other words, the brightness of the color, which is displayed based on the output signal for the first sub-pixel, the output signal for the second sub-pixel, the output signal for the third sub-pixel, and the output signal for the fourth sub-pixel, is higher than that of the input color. In this case, the difference in brightness among the pixels may possibly be made larger. As a result, performing extension based on the extension coefficient α may possibly make deterioration in the image caused by simultaneous contrast more likely to be recognized. Typical reflective liquid-crystal display devices extend input signals for the entire screen to make it brighter. Also in this case, the display device 10 according to the first embodiment increases the brightness in the predetermined hue in which deterioration in the image is likely to be recognized by the observer, thereby suppressing deterioration in the image.

Figure 11:
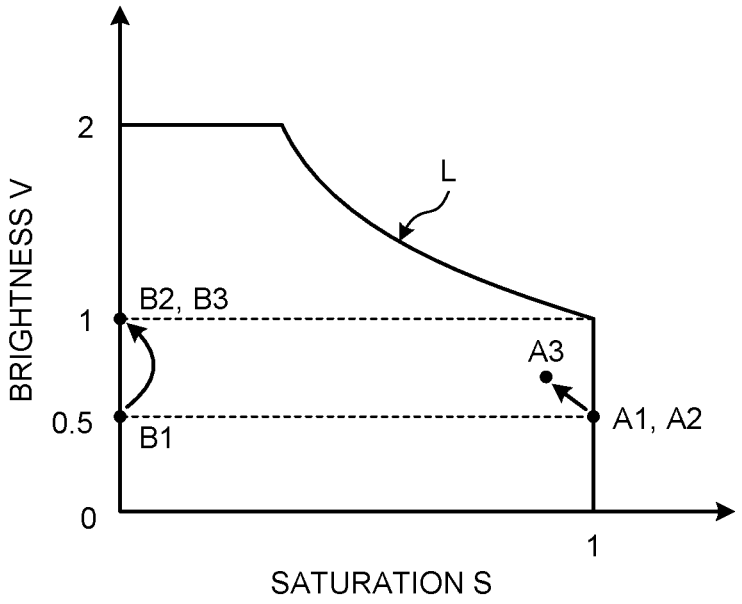
FIG. 11 is a graph of an exemplary relation between saturation and brightness in a predetermined hue.

The following describes an example where the output signal for the first sub-pixel, the output signal for the second sub-pixel, the output signal for the third sub-pixel, and the generation signal for the fourth sub-pixel are generated by the method according to the first embodiment. FIG. 11 is a graph of an exemplary relation between the saturation and the brightness in the predetermined hue. The abscissa in FIG. 11 indicates the saturation S of the input color, and the ordinate indicates the brightness V of the color extended and actually displayed by the display device 10. FIG. 11 illustrates the relation between the saturation and the brightness in a case where the hue of the input color is yellow at 60°. The line segment L in FIG. 11 indicates the maximum value of the brightness extendable in the extended color space, that is, the maximum value of the brightness displayable by the display device 10. The maximum value of the brightness varies depending on the saturation.

The following describes a case where the extension according to the first embodiment is performed on a signal value A1 (that is, pure yellow) having a predetermined input signal value of saturation of 1 and brightness of 0.5 of the input color. A2 denotes a signal value including the output signal for the first sub-pixel, the output signal for the second sub-pixel, the output signal for the third sub-pixel, and the generation signal for the fourth sub-pixel obtained by performing extension on the signal value A1. Because the saturation of the input color of the signal value A1 is 1, the extension coefficient α is 1. In other words, the signal value A2 is not extended from the signal value A1 and thus has brightness of 0.5, which is equal to the brightness of the signal value A1. A3 denotes a signal value including the output signal for the first sub-pixel, the output signal for the second sub-pixel, the output signal for the third sub-pixel, and the output signal for the fourth sub-pixel generated from the generation signal for the fourth sub-pixel having the signal value A2. Because the saturation of the input color of the signal value A1 is 1 and the hue is yellow, the signal value of the output signal for the fourth sub-pixel is obtained by adding $k1_{max}$ to the signal value of the generation signal for the fourth sub-pixel. As a result, the brightness of the signal value A3 is higher than that of the signal values A1 and A2. Thus, when receiving an input signal having the signal value A1, for example, the display device 10 can brighten the color to be displayed.

The following describes a case where the extension according to the first embodiment is performed on a signal value B1 (that is, white) having a predetermined input signal value of saturation of 0 and brightness of 0.5 of the input color. B2 denotes a signal value including the output signal for the first sub-pixel, the output signal for the second sub-pixel, the output signal for the third sub-pixel, and the generation signal for the fourth sub-pixel obtained by performing extension on the signal value B1. Because the saturation of the input color of the signal value B1 is 0, the extension coefficient α is 2. In other words, the signal value B2 is extended from the signal value B1 and thus has brightness of 1, which is higher than the brightness of the signal value B1. B3 denotes a signal value including the output signal for the first sub-pixel, the output signal for the second sub-pixel, the output signal for the third sub-pixel, and the output signal for the fourth sub-pixel generated from the generation signal for the fourth sub-pixel having the signal value B2. Because the saturation of the input color of the signal value B1 is 0, the correction value k is 0, and the signal value of the output signal for the fourth sub-pixel is equal to that of the generation signal for the fourth sub-pixel. As a result, the brightness of the signal value B3 is equal to that of the signal value B2.

In a case where the input color has a hue in which deterioration in the image is more likely to be recognized and has higher saturation, the display device 10 according to the first embodiment brightens the image based on the correction value k. By contrast, in a case where the input color has a hue in which deterioration in the image is less likely to be recognized or has lower saturation, the display device 10 according to the first embodiment brightens the image based on the extension coefficient α, while does not brighten based on the correction value k. Thus, the display device 10 can reduce the difference in brightness between these cases as indicated by the signal values A3 and B3 in FIG. 11, thereby appropriately suppressing deterioration in the image caused by simultaneous contrast.

Figure 12:
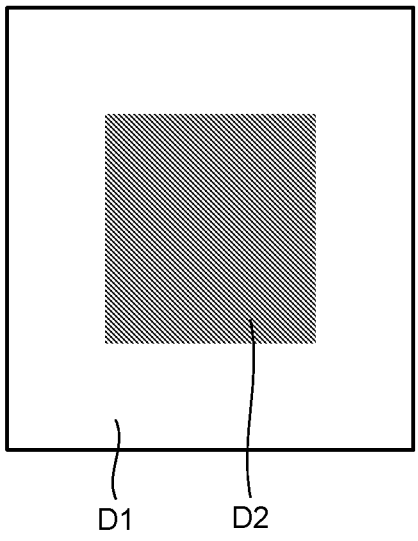
FIG. 12 is a diagram of an example of an image in which two colors with different hues are displayed.
Figure 13:
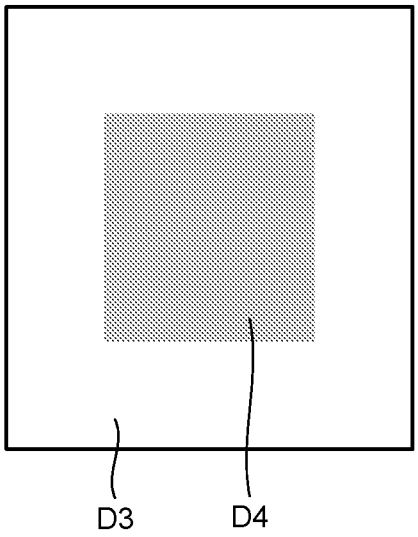
FIG. 13 is a diagram of another example of an image in which two colors with different hues are displayed.

FIGS. 12 and 13 are diagrams of examples of an image in which two colors with different hues are displayed. FIG. 12 illustrates an image having a white part D1 and a yellow part D2. The white part D1 displays white, which has higher luminance, and the yellow part D2 displays a color with a hue of yellow, which has lower luminance than that of the white part D1. FIG. 12 illustrates an image obtained by using the generation signal value $XA_{4-(p,q)}$ for the fourth sub-pixel as the output signal value $X_{4-(p,q)}$ for the fourth sub-pixel without using the correction value k unlike the first embodiment. FIG. 13 illustrates an image having a white part D3 and a yellow part D4. The white part D3 displays white based on the same input signal as that for the white part D1, and the yellow part D4 displays a color with a hue of yellow based on the same input signal as that for the yellow part D2. FIG. 13 illustrates an image obtained by deriving the output signal value $X_{4-(p,q)}$ for the fourth sub-pixel based on the generation signal value $XA_{4-(p,q)}$ for the fourth sub-pixel and the correction value $k_{(p,q)}$ like the first embodiment.

Because the output signal value $X_{4-(p,q)}$ for the fourth sub-pixel in the yellow part D4 in FIG. 13 is further extended by the correction value k, the brightness of the yellow part D4 is higher than that of the yellow part D2 in FIG. 12. Because the white part D3 in FIG. 13 displays white (has saturation of 0), the correction value k is 0. As a result, the output signal value $X_{4-(p,q)}$ for the fourth sub-pixel in the white part D3 is not extended by the correction value k, whereby the brightness of the white part D3 is equal to that of the white part D1 in FIG. 12. In comparison between FIGS. 12 and 13, the yellow part D2 in FIG. 12 looks darker than the white part D1, whereas the yellow part D4 in FIG. 13 does not look darker than the yellow part D2 in FIG. 12. Thus, the display device 10 according to the first embodiment can suppress deterioration in the image caused by simultaneous contrast.

2. Second Embodiment

The following describes a second embodiment. A display device 10*a* according to the second embodiment is different from the display device 10 according to the first embodiment in that the display device 10*a* is a transmissive liquid-crystal display device. Explanation will be omitted for portions in the display device 10*a* according to the second embodiment common to those in the display device 10 according to the first embodiment.

Figure 14:
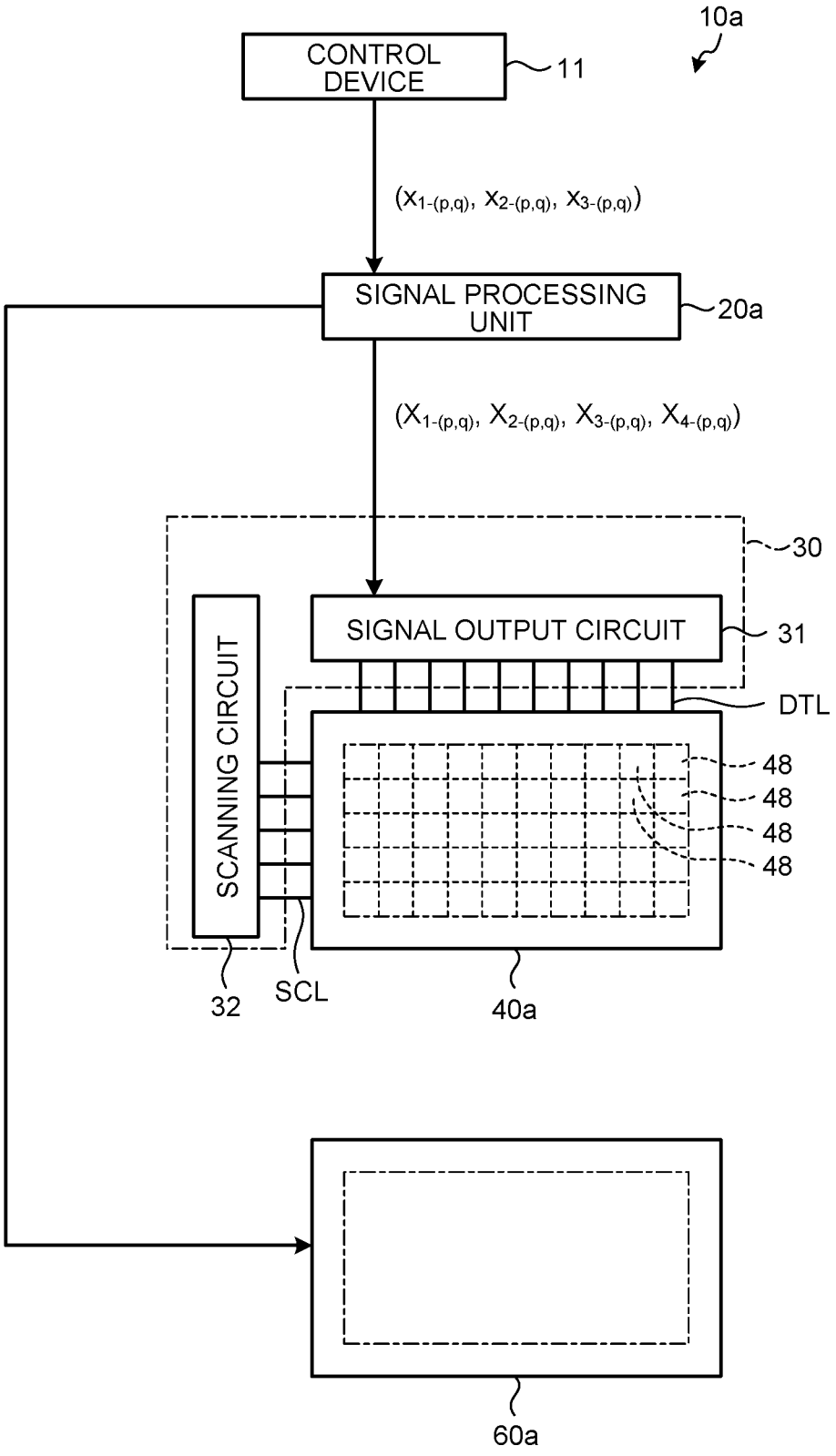
FIG. 14 is a block diagram of a configuration of a display device according to a second embodiment.

FIG. 14 is a block diagram of the configuration of the display device according to the second embodiment. As illustrated in FIG. 14, the display device 10*a* according to the second embodiment includes a signal processing unit 20*a*, an image display panel 40*a*, and a light source unit 60*a*. The display device 10*a* displays an image as follows. The signal processing unit 20*a* transmits signals to each unit of the display device 10*a*. The image-display-panel driving unit 30 controls the drive of the image display panel 40*a* based on the signals transmitted from the signal processing unit 20*a*. The image display panel 40*a* displays an image based on signals transmitted from the image-display-panel driving unit 30. The light source unit 60*a* irradiates the back surface of the image display panel 40*a* based on the signals transmitted from the signal processing unit 20*a*.

The image display panel 40*a* is a transmissive liquid-crystal display panel. The light source unit 60*a* is provided at the side of the back surface (surface opposite to the image display surface) of the image display panel 40*a*. The light source unit 60*a* irradiates the image display panel 40*a* with light under the control of the signal processing unit 20*a*. Thus, the light source unit 60*a* irradiates the image display panel 40*a*, thereby displaying an image. The luminance of light emitted from the light source unit 60*a* is fixed independently of the extension coefficient α.

The signal processing unit 20*a* according to the second embodiment also generates the output signal for the first sub-pixel, the output signal for the second sub-pixel, the output signal for the third sub-pixel, and the output signal for the fourth sub-pixel in the same manner as of the signal processing unit 20 according to the first embodiment. Similarly to the display device 10 according to the first embodiment, the display device 10*a* according to the second embodiment prevents a certain color from looking darker because of simultaneous contrast, making it possible to suppress deterioration in the image.

In the display device 10*a* according to the second embodiment, the luminance of light emitted from the light source unit 60*a* is fixed independently of the extension coefficient α. In other words, even when the input signals are extended by the extension coefficient α, the display device 10*a* does not reduce the luminance of light from the light source unit 60*a* to display the image brightly. As a result, the difference in brightness among the pixels may possibly be made larger, thereby making deterioration in the image caused by simultaneous contrast more likely to be recognized. In this case, the display device 10*a* increases the brightness in the predetermined hue in which deterioration in the image is likely to be recognized by the observer as described above, making it possible to suppress deterioration in the image. The display device 10*a* may change the luminance of light from the light source unit 60*a* depending on the extension coefficient α. The display device 10*a*, for example, may set the luminance of light from the light source unit 60*a* to 1/α. With this setting, the display device 10*a* can prevent the image from looking darker and reduce power consumption. Also in this case, the signal processing unit 20*a* generates the output signal for the first sub-pixel, the output signal for the second sub-pixel, the output signal for the third sub-pixel, and the output signal for the fourth sub-pixel in the same manner as of the signal processing unit 20 according to the first embodiment. Thus, the display device 10*a* can suppress deterioration in the image.

Modification

The following describes a modification of the second embodiment. A display device 10*b* according to the modification is different from the display device 10*a* according to the second embodiment in that the display device 10*b* switches the method for calculating the extension coefficient α.

A signal processing unit 20*b* according to the modification calculates the extension coefficient α by another method besides the method for calculating the extension coefficient α according to the first and the second embodiments. Specifically, the signal processing unit 20*b* calculates the extension coefficient α using the following Equation (12) based on the brightness V(S) of the input color and Vmax(S) of the extended color space.

$$\alpha = V\max(S)/V(S) \quad (12)$$

Vmax(S) denotes the maximum value of the brightness extendable in the extended color space illustrated in FIG. 5. Vmax(S) is expressed by the following Equations (13) and (14).

Given $S \leq S_0$ is satisfied, $$V\max(S) = (\chi+1)\cdot(2^n-1) \quad (13)$$

Given $S_0 < S \leq 1$ is satisfied, $$V\max(S) = (2^n-1)\cdot(1/S) \quad (14)$$

where $S_0 = 1/(\chi+1)$ is satisfied.

The signal processing unit 20*b* switches the method for calculating the extension coefficient α according to the first embodiment and the method for calculating it using Equation (12). For example, to brighten the image as much as possible in an environment where the intensity of external light is relatively higher than the display luminance, such as outdoors, the signal processing unit 20*b* uses the method for calculating the extension coefficient α according to the first embodiment. A case where the method for calculating the extension coefficient α according to the first embodiment is employed is hereinafter referred to as an outdoor mode. If the signal processing unit 20*b* receives a signal for selecting the outdoor mode from an external switch or if the intensity of external light higher than a predetermined value is received, the signal processing unit 20*b* switches the mode to the outdoor mode to select the method for calculating the extension coefficient α in the outdoor mode. If the signal processing unit 20*b* receives no signal for selecting the outdoor mode or if the intensity of external light higher than the predetermined value is not received (normal mode), the signal processing unit 20*b* calculates the extension coefficient α using Equation (12). In the normal mode, the display device 10*b* sets the luminance of light from the light source unit 60*a* to 1/α. With this setting, the display device 10*b* prevents the image from looking darker and reduces power consumption.

Figure 15:
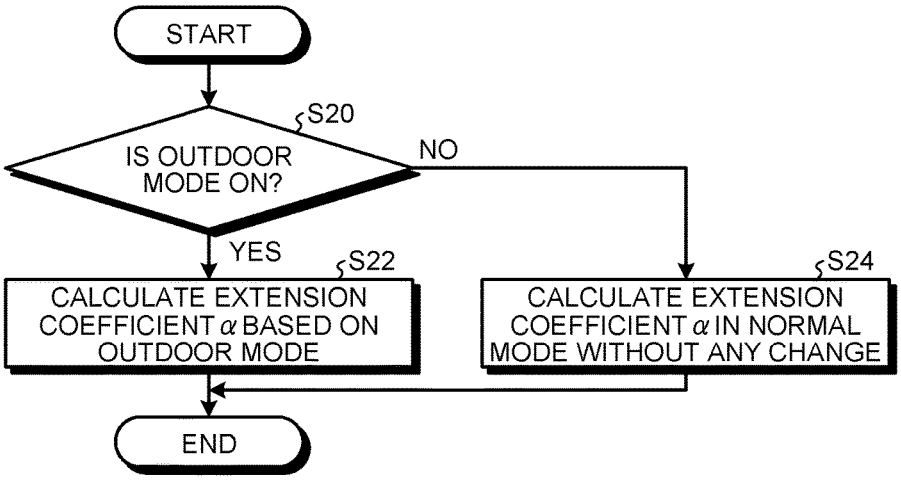
FIG. 15 is a flowchart of a method for switching a calculation method for the extension coefficient.

FIG. 15 is a flowchart of a method for switching the calculation method for the extension coefficient. If the outdoor mode is not on, the signal processing unit 20*b* calculates the extension coefficient α in the normal mode. As illustrated in FIG. 15, the signal processing unit 20*b* determines whether the outdoor mode is on (Step S20). Specifically, the signal processing unit 20*b* determines whether it has received a signal for selecting the outdoor mode from the external switch or whether the intensity of external light higher than the predetermined value is received.

If the outdoor mode is on (Yes at Step S20), the signal processing unit 20*b* calculates the extension coefficient α based on the outdoor mode (Step S22).

By contrast, if the outdoor mode is not on (No at Step S20), the signal processing unit 20*b* keeps the normal mode and calculates the extension coefficient α in the normal mode (Step S24). Specifically, the signal processing unit 20*b* calculates the extension coefficient α using Equation (12). With this operation, the signal processing unit 20*b* switches the method for calculating the extension coefficient α.

The reflective display device 10 according to the first embodiment may also perform the process of switching the method for calculating the extension coefficient α explained in the modification. Furthermore, the display device 10 according to the first embodiment and the display device 10*a* according to the second embodiment may calculate the extension coefficient α using Equation (12).

3. Application Examples

Figure 16:
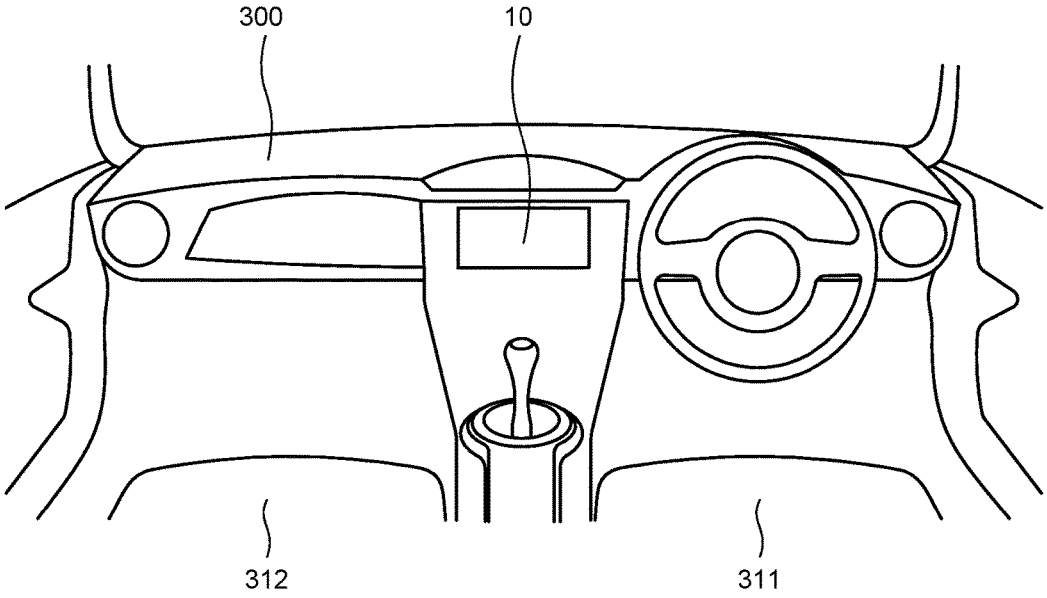
FIG. 16 is a diagram illustrating an example of an electronic apparatus to which the display device according to the first embodiment is applied.
Figure 17:
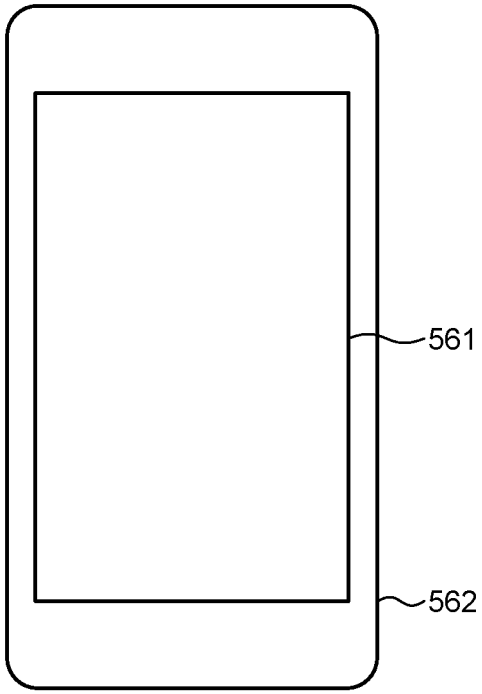
FIG. 17 is a diagram illustrating an example of an electronic apparatus to which the display device according to the first embodiment is applied.

The following describes application examples of the display device 10 described in the first embodiment with reference to FIGS. 16 and 17. FIGS. 16 and 17 are diagrams illustrating examples of an electronic apparatus to which the display device according to the first embodiment is applied. The display device 10 according to the first embodiment can be applied to electronic apparatuses in various fields, such as automotive navigation systems such as one illustrated in FIG. 16, television devices, digital cameras, laptop computers, portable electronic apparatuses including mobile phones such as one illustrated in FIG. 17, and video cameras. In other words, the display device 10 according to the first embodiment can be applied to electronic apparatuses in various fields that display externally received video signals or internally generated video signals as images or videos. Each of such electronic apparatuses includes the control device 11 (refer to FIG. 1) that supplies video signals to the display device and controls operations of the display device. The application examples given here can be applied to, in addition to the display device 10 according to the first embodiment, the display devices according to the other embodiments, the modification, and the other examples described above.

The electronic apparatus illustrated in FIG. 16 is an automotive navigation device to which the display device 10 according to the first embodiment is applied. The display device 10 is installed on a dashboard 300 in the interior of an automobile. Specifically, the display device 10 is installed between a driver seat 311 and a passenger seat 312 on the dashboard 300. The display device 10 of the automotive navigation device is used for navigation display, display of an audio control screen, reproduction display of a movie, or the like.

The electronic apparatus illustrated in FIG. 17 is a portable information apparatus to which the display device 10 according to the first embodiment is applied. The portable information apparatus operates as a portable computer, a multifunctional mobile phone, a mobile computer allowing a voice communication, or a communicable portable computer, and is sometimes called a smartphone or a tablet terminal. The portable information apparatus includes, for example, a display unit 561 on a surface of a housing 562. The display unit 561 includes the display device 10 according to the first embodiment, and has a touch detection (what is called a touch panel) function that enables detection of an external proximity object.

While the embodiments and the modification of the present invention have been described above, the embodiments and the like are not limited to the contents thereof. The components described above include components easily conceivable by those skilled in the art, substantially the same components, and components in the range of what are called equivalents. The components described above can also be appropriately combined with each other. In addition, the components can be variously omitted, replaced, or modified without departing from the gist of the embodiments and the like described above.

4. Aspects of the Present Disclosure

The present disclosure includes the following aspects.

(1) A display device comprising:

an image display panel including a plurality of pixels each having a first sub-pixel that displays a first color, a second sub-pixel that displays a second color, a third sub-pixel that displays a third color, and a fourth sub-pixel that displays a fourth color; and a signal processing unit that converts an input value of an input signal into an extended value in a color space extended by the first color, the second color, the third color, and the fourth color to generate an output signal and outputs the generated output signal to the image display panel, wherein the signal processing unit determines an extension coefficient for the image display panel, the signal processing unit derives a generation signal for the fourth sub-pixel in each of the pixels based on an input signal for the first sub-pixel, an input signal for the second sub-pixel, an input signal for the third sub-pixel, and the extension coefficient, the signal processing unit derives an output signal for the first sub-pixel in each of the pixels based on at least the input signal for the first sub-pixel, the extension coefficient, and the generation signal for the fourth sub-pixel and outputs the output signal to the first sub-pixel, the signal processing unit derives an output signal for the second sub-pixel in each of the pixels based on at least the input signal for the second sub-pixel, the extension coefficient, and the generation signal for the fourth sub-pixel and outputs the output signal to the second sub-pixel, the signal processing unit derives an output signal for the third sub-pixel in each of the pixels based on at least the input signal for the third sub-pixel, the extension coefficient, and the generation signal for the fourth sub-pixel and outputs the output signal to the third sub-pixel, the signal processing unit derives a correction value for deriving an output signal for the fourth sub-pixel based on a hue of an input color corresponding to a color to be displayed based on the input signal for the first sub-pixel, the input signal for the second sub-pixel, and the input signal for the third sub-pixel, and the signal processing unit derives the output signal for the fourth sub-pixel in each of the pixels based on the generation signal for the fourth sub-pixel and the correction value and outputs the output signal to the fourth sub-pixel.

(2) The display device according to (1), wherein the signal processing unit derives the output signal for the fourth sub-pixel by adding the correction value to a signal value of the generation signal for the fourth sub-pixel.

(3) The display device according to (1) or (2), wherein the correction value increases as the hue of the input color is closer to a predetermined hue.

(4) The display device according to (3), wherein the correction value is 0 when the hue of the input color is a first hue and a second hue different from the predetermined hue, increases as the hue of the input color is closer to the predetermined hue from the first hue, and increases as the hue of the input color is closer to the predetermined hue from the second hue.

(5) The display device according to (4), wherein the correction value is 0 when the hue of the input color falls within a range out of a hue range from the first hue to the second hue, the hue range including the predetermined hue.

(6) The display device according to (5), wherein the predetermined hue is yellow, the first hue is red, and the second hue is green.

(7) The display device according to any one of (1) to (6), wherein the correction value increases as saturation of the input color increases.

(8) The display device according to (7), wherein the correction value includes a first correction term derived based on the hue of the input color and a second correction term that increases as the saturation of the input color increases, and the signal processing unit derives the output signal for the fourth sub-pixel by adding the product of the first correction term and the second correction term to the signal value of the generation signal for the fourth sub-pixel.

(9) The display device according to any one of (1) to (8), wherein brightness of a color displayed based on the output signal for the first sub-pixel, the output signal for the second sub-pixel, the output signal for the third sub-pixel, and the output signal for the fourth sub-pixel is higher than brightness of the input color.

(10) The display device according to (9), wherein the extension coefficient varies depending on the saturation of the input color.

(11) The display device according to any one of (1) to (10), wherein the first sub-pixel, the second sub-pixel, the third sub-pixel, and the fourth sub-pixel each include a reflection unit that reflects light entering from a front surface of the image display panel and display an image with the light reflected by the reflection unit.

(12) The display device according to any one of (1) to (10), further comprising a light source unit that is provided at a back surface side of the image display panel opposite to a display surface on which the image is displayed and that irradiates the image display panel with light.

(13) A method for driving a display device comprising an image display panel including a plurality of pixels each having a first sub-pixel that displays a first color, a second sub-pixel that displays a second color, a third sub-pixel that displays a third color, and a fourth sub-pixel that displays a fourth color, the method for driving the display device comprising:

deriving an output signal for each of the first sub-pixel, the second sub-pixel, the third sub-pixel, and the fourth sub-pixel; and controlling an operation of the first sub-pixel, the second sub-pixel, the third sub-pixel, and the fourth sub-pixel based on the output signal, wherein the deriving of the output signal comprises:

determining an extension coefficient for the image display panel;

deriving a generation signal for the fourth sub-pixel based on an input signal for the first sub-pixel, an input signal for the second sub-pixel, an input signal for the third sub-pixel, and the extension coefficient;

deriving the output signal for the first sub-pixel based on at least the input signal for the first sub-pixel, the extension coefficient, and the generation signal for the fourth sub-pixel and outputting the output signal to the first sub-pixel;

deriving the output signal for the second sub-pixel based on at least the input signal for the second sub-pixel, the extension coefficient, and the generation signal for the fourth sub-pixel and outputting the output signal to the second sub-pixel;

deriving the output signal for the third sub-pixel in each of the pixels based on at least the input signal for the third sub-pixel, the extension coefficient, and the generation signal for the fourth sub-pixel and outputting the output signal to the third sub-pixel;

deriving a correction value for deriving the output signal for the fourth sub-pixel based on a hue of an input color corresponding to a color displayed based on the input signal for the first sub-pixel, the input signal for the second sub-pixel, and the input signal for the third sub-pixel; and deriving the output signal for the fourth sub-pixel based on the generation signal for the fourth sub-pixel and the correction value and outputting the output signal to the fourth sub-pixel.

What is claimed is:

1. A display device comprising:

an image display panel including a plurality of pixels each having a first sub-pixel that displays a first color, a second sub-pixel that displays a second color, a third sub-pixel that displays a third color, and a fourth subpixel that displays a fourth color; and a signal processing unit that converts an input value of an input signal into an extended value in a color space extended by the first color, the second color, the third color, and the fourth color to generate an output signal, and outputs the generated output signal to the image display panel, wherein the signal processing unit determines an extension coefficient for the image display panel, the signal processing unit derives a generation signal for the fourth sub-pixel in each of the pixels based on an input signal for the first sub-pixel, an input signal for the second sub-pixel, an input signal for the third subpixel, and the extension coefficient, the signal processing unit derives an output signal for the first sub-pixel in each of the pixels based on at least the input signal for the first sub-pixel, the extension coefficient, and the generation signal for the fourth sub-pixel, and outputs the output signal to the first sub-pixel, the signal processing unit derives an output signal for the second sub-pixel in each of the pixels based on at least the input signal for the second sub pixel, the extension coefficient, and the generation signal for the fourth sub-pixel, and outputs the output signal to the second sub-pixel, the signal processing unit derives an output signal for the third sub-pixel in each of the pixels based on at least the input signal for the third sub-pixel, the extension coefficient, and the generation signal for the fourth sub-pixel and outputs the output signal to the third sub-pixel, the signal processing unit derives a correction value for deriving an output signal for the fourth sub-pixel based on a hue of an input color corresponding to a color to be displayed based on the input signal for the first sub-pixel, the input signal for the second sub-pixel, and the input signal for the third sub-pixel, and the signal processing unit derives the output signal for the fourth sub-pixel in each of the pixels based on the generation signal for the fourth sub-pixel and the correction value, and outputs the output signal to the fourth sub-pixel.

2. The display device according to claim 1, wherein the signal processing unit derives the output signal for the fourth sub-pixel by adding the correction value to a signal value of the generation signal for the fourth sub-pixel.

3. The display device according to claim 1, wherein the correction value increases as the hue of the input color is closer to a predetermined hue.

4. The display device according to claim 3, wherein the correction value is 0 when the hue of the input color is a first hue and a second hue different from the predetermined hue, increases as the hue of the input color is closer to the predetermined hue from the first hue, and increases as the hue of the input color is closer to the predetermined hue from the second hue.

5. The display device according to claim 4, wherein the correction value is 0 when the hue of the input color falls within a range out of a hue range from the first hue to the second hue, the hue range including the predetermined hue.

6. The display device according to claim 5, wherein the predetermined hue is yellow, the first hue is red, and the second hue is green.

7. The display device according to claim 1, wherein the correction value increases as saturation of the input color increases.

8. The display device according to claim 7, wherein the correction value includes a first correction term derived based on the hue of the input color and a second correction term that increases as the saturation of the input color increases, and the signal processing unit derives the output signal for the fourth sub-pixel by adding the product of the first correction term and the second correction term to the signal value of the generation signal for the fourth sub-pixel.

9. The display device according to claim 1, wherein brightness of a color displayed based on the output signal for the first sub-pixel, the output signal for the second sub-pixel, the output signal for the third sub-pixel, and the output signal for the fourth sub-pixel is higher than brightness of the input color.

10. The display device according to claim 9, wherein the extension coefficient varies depending on the saturation of the input color.

11. The display device according to claim 1, wherein the first sub-pixel, the second sub-pixel, the third sub-pixel, and the fourth sub-pixel each include a reflection unit that reflects light entering from a front surface of the image display panel and display an image with the light reflected by the reflection unit.

12. The display device according to claim 1, further comprising a light source unit that is provided at a back surface side of the image display panel opposite to a display surface on which the image is displayed and that irradiates the image display panel with light.

13. A method for driving a display device comprising an image display panel including a plurality of pixels each having a first sub-pixel that displays a first color, a second sub-pixel that displays a second color, a third subpixel that displays a third color, and a fourth sub-pixel that displays a fourth color, the method for driving the display device comprising:

deriving an output signal for each of the first subpixel, the second sub-pixel, the third sub-pixel, and the fourth sub-pixel; and controlling an operation of the first sub-pixel, the second sub-pixel, the third sub-pixel, and the fourth subpixel based on the output signal, wherein the deriving of the output signal comprises:

determining an extension coefficient for the image display panel;

deriving a generation signal for the fourth subpixel based on an input signal for the first sub-pixel, an input signal for the second sub-pixel, an input signal for the third sub-pixel, and the extension coefficient;

deriving the output signal for the first subpixel based on at least the input signal for the first subpixel, the extension coefficient, and the generation signal for the fourth sub-pixel, and outputting the output signal to the first sub-pixel;

deriving the output signal for the second subpixel based on at least the input signal for the second sub-pixel, the extension coefficient, and the generation signal for the fourth sub-pixel, and outputting the output signal to the second sub-pixel;

deriving the output signal for the third subpixel in each of the pixels based on at least the input signal for the third sub-pixel, the extension coefficient, and the generation signal for the fourth sub-pixel, and outputting the output signal to the third sub-pixel;

deriving a correction value for deriving the output signal for the fourth sub-pixel based on a hue of an input color corresponding to a color displayed based on the input signal for the first sub-pixel, the input signal for the second sub-pixel, and the input signal for the third sub-pixel; and deriving the output signal for the fourth sub pixel based on the generation signal for the fourth sub pixel and the correction value, and outputting the output signal to the fourth sub-pixel.

* * * * *